US010145129B2

(12) United States Patent
Bains

(10) Patent No.: US 10,145,129 B2
(45) Date of Patent: Dec. 4, 2018

(54) MODULAR PLATFORM

(71) Applicant: THREE G METAL FABRICATIONS LIMITED, Leicester (GB)

(72) Inventor: Gurdip Singh Bains, Leicester (GB)

(73) Assignee: THREE G METAL FABRICATIONS LIMITED, Leicester (GB)

( * ) Notice: Subject to any disclaimer, the term of this patent is extended or adjusted under 35 U.S.C. 154(b) by 0 days.

(21) Appl. No.: 14/351,531

(22) PCT Filed: Oct. 15, 2012

(86) PCT No.: PCT/GB2012/052554

§ 371 (c)(1),
(2) Date: Apr. 11, 2014

(87) PCT Pub. No.: WO2013/054143

PCT Pub. Date: Apr. 18, 2013

(65) Prior Publication Data

US 2014/0262619 A1 Sep. 18, 2014

(30) Foreign Application Priority Data

| | | |
|---|---|---|
| Oct. 13, 2011 | (GB) | 1117717.7 |
| Jan. 13, 2012 | (GB) | 1200560.9 |
| Sep. 7, 2012 | (GB) | 1216020.6 |

(51) Int. Cl.
*E04G 1/15* (2006.01)
*E04G 1/06* (2006.01)
(Continued)

(52) U.S. Cl.
CPC ..... *E04G 1/154* (2013.01); *E04G 1/06* (2013.01); *E04G 1/15* (2013.01); *E04G 5/02* (2013.01);
(Continued)

(58) Field of Classification Search
CPC ..... E04G 1/154; E04G 5/14; E04G 7/302; E04G 5/02; E04G 5/16; E04G 7/306; E04G 1/06
See application file for complete search history.

(56) References Cited

U.S. PATENT DOCUMENTS

| | | | | |
|---|---|---|---|---|
| 3,179,212 A | | 4/1965 | Gostling | |
| 3,506,090 A | * | 4/1970 | Beziat | E04G 1/00 182/178.6 |

(Continued)

FOREIGN PATENT DOCUMENTS

| | | |
|---|---|---|
| AU | 2002 301 442 B2 | 2/2007 |
| CA | 1 234 298 A | 3/1988 |

(Continued)

OTHER PUBLICATIONS

International Preliminary Report on Patentability for Application No. PCT/GB2012/052554, dated Apr. 15, 2014.

(Continued)

*Primary Examiner* — Alvin C Chin-Shue
(74) *Attorney, Agent, or Firm* — Marshall, Gerstein & Borun LLP

(57) ABSTRACT

We provide a platform (10) comprising a deck element (14) having a load-bearing member (18) secured to at least one support beam (16) of the deck element (14), and a plurality of first connection arrangements, and a plurality of deck support members (30) each having a second connection arrangement, wherein the deck element (14) is moveable with respect to the plurality of deck support members (30) to connect the deck element (14) to the plurality of deck support members (30), and wherein each of the first connection arrangements is configured to engage a respective one of the second connection arrangements, the first connection arrangement being one of an engaging member (20) or a receiving formation (35), and the respective second (Continued)

connection arrangement being the other of an engaging member (20) or a receiving formation (35), such that movement of the engaging member (20) in a first engaging direction causes the engaging member (20) to engage the receiving formation (35), to restrict movement of the deck element (14) relative to the respective deck support member (30) in at least one plane.

12 Claims, 18 Drawing Sheets

(51) Int. Cl.

| | |
|---|---|
| ***E04G 5/02*** | (2006.01) |
| ***E04G 5/16*** | (2006.01) |
| ***E04G 7/30*** | (2006.01) |
| ***E04G 7/34*** | (2006.01) |
| ***E04G 5/14*** | (2006.01) |

(52) U.S. Cl.
CPC ..... *E04G 5/14* (2013.01); *E04G 5/16* (2013.01); *E04G 7/302* (2013.01); *E04G 7/306* (2013.01); *E04G 7/34* (2013.01); *Y10T 29/49826* (2015.01)

(56) References Cited

U.S. PATENT DOCUMENTS

| | | | | | |
|---|---|---|---|---|---|
| 3,613,832 | A * | 10/1971 | Dunster | E04G 7/307 | 182/186.7 |
| 3,752,262 | A * | 8/1973 | Helms | E04G 5/14 | 182/113 |
| 5,287,947 | A * | 2/1994 | McSwain | E04G 11/48 | 182/186.7 |
| 6,220,392 | B1 | 4/2001 | Schwoerer | | |
| 6,419,046 | B1 * | 7/2002 | Cubbison | E04G 5/002 | 182/119 |
| 6,443,262 | B1 * | 9/2002 | Karanouh | E04G 1/14 | 182/152 |
| 2010/0000822 | A1 | 1/2010 | Wall | | |

FOREIGN PATENT DOCUMENTS

| | | | | |
|---|---|---|---|---|
| DE | 19 02 741 | U | 10/1964 | |
| DE | 93 14 364 | U1 | 12/1993 | |
| DE | 9314364 | U1 * | 12/1993 | E04G 1/15 |
| DE | 197 11 496 | A1 | 9/1998 | |
| EP | 1 094 175 | A1 | 4/2001 | |
| EP | 1862610 | A1 * | 12/2007 | E04G 1/15 |
| FR | 1 222 710 | A | 6/1960 | |
| FR | 1 587 165 | A | 3/1970 | |
| WO | WO-90/14479 | A1 | 11/1990 | |

OTHER PUBLICATIONS

International Search Report and Written Opinion for Application No. PCT/GB2012/052554, dated Apr. 25, 2013.

Communication Pursuant to Article 94(3) EPC issued in Great Britain Pat. Appl. No. 12791225.1-1602 dated May 30, 2016.

* cited by examiner

MODULAR PLATFORM

This invention relates to modular platforms, and to a method of erecting a platform. The invention relates in particular, but not exclusively, to platforms suitable for use as scaffolding on a construction site.

It is well known for scaffolding to be deployed on building construction sites, where it is necessary for workmen to work at a level raised from the ground. Scaffolding systems are typically slow to deploy and to take down, due to the number of support poles required to construct a suitably secure frame. In order to connect scaffolding poles securely to one another, a large number of securing parts (such as pins, braces, bolts, and the like) are required. In order to ensure the structural integrity of the scaffolding, it is essential that each scaffolding component is securely connected to the other parts. This means that each connection must be checked carefully for the scaffolding to be deemed suitable for supporting the weight of workmen, and building components.

Modular platforms are commonly used on building sites, to provide a simplified structure for supporting workmen and building components. Modular systems may comprise a standard set of support frame components and platforms, which may be erected more easily than traditional scaffolding. The platforms and support frames may include standardised connectors to connect the components to one another, allowing workmen to erect the frame and platforms more quickly.

Current modular platforms still require a significant amount of time and skill to assemble, since each section of platform may require horizontal edge support bars to be carefully secured to a raised support structure, in order to support a decking surface which may be laid on top. Whilst the components of modular platforms are designed to be simpler to connect to one another than traditional scaffolding poles and boards, if the components of the platform are to be connected securely, further connecting parts must be fitted to the platforms before they are safe to support a significant load. For example, it may be necessary for holes to be drilled in support legs, to allow support braces to be attached to them, to provide the platform with sufficient structural support. Furthermore, it is common for the surfaces (or 'decking') of such platforms to be laid on top of a modular frame, rather than being secured to it. In order to ensure that the platform surface is secured to the frame, so that it cannot simply be lifted from the frame, further securing components must be fitted by workmen.

The present invention seeks to address or overcome one or more of these issues.

According to an embodiment of the invention we provide a platform comprising a deck element having a load-bearing member secured to at least one support beam of the deck element, and a plurality of first connection arrangements and a plurality of deck support members each having a second connection arrangement, wherein the deck element is moveable with respect to the plurality of deck support members to connect the deck element to the plurality of deck support members, and wherein each of the first connection arrangements is configured to engage a respective one of the second connection arrangements, the first connection arrangement being one of an engaging member or a receiving formation, and the respective second connection arrangement being the other of an engaging member or a receiving formation, such that movement of the engaging member in a first engaging direction causes the engaging member to engage the receiving formation, to restrict movement of the deck element relative to the respective deck support member in at least one plane.

Each deck support member comprises a deck support leg.

The platform may further comprise a plurality of stabilising feet, each foot comprising a sleeve adapted to receive a first end of a respective one of the plurality of deck support legs, and a stabilising portion extending outwardly from the sleeve portion.

The sleeve of the foot may define a peripheral aperture, and the first end of the respective deck support leg may define an opening adapted to align with the aperture defined by the upright sleeve for receiving a retaining member so as to secure the deck support leg relative to the stabilising foot.

The platform may further include one or more support members having a body with a first end and a second end, wherein the first end of the support member includes a first securing arrangement configured for securing the first end of the support member relative to a first one of the deck support legs and the second end of the support member includes a second securing arrangement for securing the second end of the support member relative to a second one of the deck support legs, so as to hold the first deck support leg relative to the second deck support leg.

The first securing arrangement may comprise a connecting sleeve that is adapted to surround a portion of the first end of the first deck support leg.

The connecting sleeve may be adapted to surround a portion of the sleeve of the foot, the connecting sleeve defining a peripheral aperture adapted to align with the aperture defined by the sleeve of the foot and with the opening in the deck support leg so as to receive the retaining member to secure the deck support leg, the stabilising foot, and the support member relative to each other.

The connecting sleeve may define a pair of peripherally spaced apertures, the sleeve of the foot defining a pair of peripherally spaced apertures adapted to align with the apertures through the connecting sleeve, and the opening within the deck support leg passes therethrough, so as to align with the apertures through the sleeve of the foot and connecting sleeve, for receiving a retaining member therethrough.

The second securing arrangement may comprise a first arm and a second arm, each arm being fixed substantially rigidly relative to the body of the support member, and each of the first and second arms being configured to surround at least partially a portion of the respective second deck support leg.

Each of the first and second arms may comprise a first portion disposed generally outwardly from the body of the support member, and a second portion forming a substantially rigid elbow joint with the first portion such that the second portion is disposed generally perpendicular to the first portion, the second portion of the first arm extending from the first portion of the first arm generally toward the second arm, and the second portion of the second arm extending from the first portion of the second arm generally toward the first arm, such that each arm surrounds a portion of the perimeter of the second deck support leg.

The second portion of each of the first arm and second arm may comprise a frictional sleeve, providing a surface for abutting a portion of the second deck support leg so as to resist relative movement between the arm and the deck support.

The platform may further comprise at least one barrier arrangement comprising a pair of support posts, each support post having at a first end a third connection arrangement for engagement with a fourth connection arrangement disposed at a second end of a respective deck support leg such that the support post is connected to and supported by the respective deck support leg, and a fifth connection arrangement disposed at a position on the length of the support post, and a barrier member having a first end and a second end, each end comprising a sixth connection arrangement for engagement with a respective fifth connection arrangement of a respective one of the support posts, such that the barrier member is connected to and supported by the pair of support posts.

Each of the fourth connection arrangements may define a recess, and each corresponding third connection arrangement comprises a corresponding engagement member adapted to be received within the recess.

The top-down profile of the load-bearing member may be generally rectangular, and the deck element comprises four support beams.

The deck element may comprise four first connection arrangements, one disposed adjacent each corner of the load-bearing member.

Each engaging member may comprise a male part that extends outwardly from the respective part comprising the engaging member, and each receiving formation may comprise a female slot arrangement for receiving the male part, including a pair of generally parallel side walls extending from the respective surface comprising the receiving formation and having an outer wall generally perpendicular to the plane of the side walls and extending between the side walls along at least a portion of their respective edges.

Each receiving formation may be provided with a fastening arrangement configured so as to secure releasably a respective engaging member in engagement with the receiving formation.

The fastening arrangement of each receiving formation may comprise a fastening member moveable between a securing position and a releasing position, the fastening member having a flexible body and a pin member protruding outwardly from the body, each side wall of the female slot arrangement defining an aperture therethrough, and the male part of the respective corresponding engaging member defining an aperture therethrough, such that when the male part is engaged with the female slot arrangement the aperture through the male part aligns with the apertures in each side wall, and wherein the fastening member is configured such that the pin member is aligned axially with the apertures so as to extend therethrough when the fastening member is in its 'securing' position thereby securing the male part in engagement with the female slot arrangement, and the pin member is retracted from within the apertures when the fastening member is in its 'releasing' position, so as to release the male part from the female slot arrangement.

The flexible body may be biased towards its securing position.

The flexible body may be moveable by a user using a digit to press against the biasing force, so as to release manually the respective male part from its respective female slot arrangement.

The first connection arrangements may be engaging members and the second connection arrangements may be receiving formations.

The first connection arrangements may be engaging members and the second connection arrangements may be receiving formations, and each receiving formation may further comprise first and second female slot arrangements.

Each fastening arrangement may comprise a first and a second fastening member, the first fastening member being configured to releasably secure a male part of a first engaging member in engagement with the first respective female slot arrangement, and the second fastening member being configured to releasably secure a male part of a second engaging member in engagement with the second respective female slot arrangement.

The platform may comprise at least one barrier arrangement comprising a first and a second support post, each support post having at a first end a third connection arrangement for engagement with a fourth connection arrangement disposed at a second end of a respective deck support leg such that the support post is connected to and supported by the respective deck support leg, a fifth connection arrangement defining a recess disposed at or adjacent a position on the length of the first support post, the second support post providing a retaining arrangement, and a barrier member having a first end providing an engagement member adapted to be received within the recess defined by the fifth connection member, and a second end comprising an sixth connection arrangement adapted to at least partially surround a portion of the second support post and configured to receive a pin for engagement with the retaining arrangement of the second support post so as substantially to prevent movement of the sixth connection arrangement relative to the second support post, such that the barrier member is connected to and supported by the pair of support posts.

The sixth connection arrangement may comprise a C-shaped channel adapted to lie adjacent three sides of a support post.

The sixth connection arrangement may further comprise a connection arrangement defining a recess for receiving an engagement member of a further barrier member.

The sixth connection arrangement may further comprise two connection arrangements each defining a recess for receiving engagement members of a respective first and second further barrier member.

The retaining arrangement may comprise an opening defined through the second support post, and the sixth connection arrangement comprises a pair of apertures configured such that the apertures align with the opening so as to receive a pin.

At least one receiving formation may be comprised by a sleeve arrangement, the sleeve arrangement comprising a sleeve portion forming a C-shaped channel adapted to abut three sides of a deck support leg, at least one wall of the sleeve portion providing the receiving formation comprising a female slot arrangement for receiving one of the male parts.

The platform may further include a latch member for engagement with a pair of slots defined at positions opposite one another adjacent either end of the C-shaped channel of the sleeve portion, so as to inhibit disengagement of the sleeve arrangement from a deck support leg abutted on three of its sides within the C-shaped channel.

An aperture may be defined by the latch member, such that alignment of that aperture with an aperture defined through the deck support leg and an aperture defined by a wall of the sleeve portion allows insertion of a portion of a bolt or pin through the aligned apertures, for restricting relative vertical movement between the sleeve arrangement and the deck support leg.

The platform may further comprise an extension element having an upper portion having substantially the same width as a deck support leg, and an engagement portion adapted to fit within an upper portion of a deck support leg, the engagement portion defining apertures configured to lie adjacent corresponding apertures defined by the deck support leg for receiving pins or bolts to secure the engagement portion relative to the deck support leg.

The platform may further comprise a buffer member comprising a body adapted to fit at least partially within an end of a support beam or a barrier member, such that a buffer surface of the buffer member protrudes from the end of the support beam or barrier member, the buffer surface being formed of a material suitable for cushioning or damping the effects of an impact.

The platform may include a further support arrangement, comprising a support member having a first end for connection to a first portion of a deck support leg and a second end configured to be supported on a surface at a position spaced from the deck support leg, and a support arm for connection between the support member and a second portion of the deck support leg, the second portion being spaced vertically from the first portion.

The second end of the support member may provide a support member foot comprising a plate configured to lie against a surface, and a pivot arrangement for providing a pivoting connection between the support member and the plate.

A platform assembly may comprise a plurality of platforms according to any one of the preceding claims.

According to an embodiment, we provide a support member for bracing a first deck support leg and second deck support leg with respect to one another, the support member comprising a body with a first end and a second end, the first end of the support member including a securing arrangement configured to secure the first end of the support member relative to the first deck support leg, and the second end of the support member including a first arm and a second arm, each arm being arranged substantially rigidly relative to the body of the support member, and each of the first and second arms being configured to surround at least partially a portion of the second deck support leg, such that the first deck support leg is braced relative to the second deck support leg by the support member.

Each of the first and second arms may comprise a first portion disposed generally outwardly from the body of the support member, and a second portion forming a rigid elbow joint with the first portion such that the second portion is disposed generally perpendicular to the first portion, the second portion of the first arm extending from the first portion of the first arm generally toward the second arm, and the second portion of the second arm extending from the first portion of the second arm generally toward the first arm, such that each arm surrounds a portion the perimeter of the second deck support leg.

The second portion of each of the first arm and second arm may comprise a frictional sleeve, providing a surface for abutting a portion of the second deck support leg so as to resist relative movement between the arm and the deck support leg.

The securing arrangement may comprise a connecting sleeve that is adapted to surround a portion of a first end of the first deck support leg.

According to an embodiment, we provide a platform comprising a deck element having a plurality of engaging members, a plurality of deck support members, each having a receiving formation, and at least one fastening arrangement, wherein each of the engaging members is configured to engage a respective one of the receiving formations, such that movement of the engaging member in a first engaging direction causes the engaging member to engage the receiving formation, to restrict movement of the deck element relative to the respective deck support member in at least one plane; and the at least one fastening arrangement is configured so as to secure a respective engaging member in releasable engagement with the receiving formation.

Each engaging member may comprise a male part that extends outwardly from the respective part comprising the engaging member, and each receiving formation may comprise a female slot arrangement for receiving the male part, including a pair of generally parallel side walls extending from the respective surface comprising the receiving formation and having an outer wall generally perpendicular to the plane of the side walls and extending between the side walls along at least a portion of their respective edges.

The fastening arrangement of each receiving formation may comprise a fastening member moveable between a securing position and a releasing position, the fastening member having a flexible body and a pin member protruding outwardly from the body, each side wall of the female slot arrangement defining an aperture therethrough, and the male part of the respective corresponding engaging member defining an aperture therethrough, such that when the male part is engaged with the female slot arrangement the aperture through the male part aligns with the apertures defined by each side wall, and wherein the fastening member is configured such that the pin member is aligned axially with the apertures so as to extend therethrough when the fastening member is in its securing position thereby securing the male part in engagement with the female slot arrangement, and the pin member is retracted from within the apertures when the fastening member is in its releasing position, so as to release the male part from the female slot arrangement.

The flexibly body may be biased towards its securing position.

The flexible body may be moveable by a user using a digit to press against the biasing force, so as to release manually the respective male part from its respective female slot arrangement.

According to an embodiment, we provide a method of assembling a platform of the type comprising a deck element having a plurality of first connection arrangements, and a plurality of deck support legs each having a second connection arrangement, each of the first connection arrangements being configured to engage a respective one of the second connection arrangements, the first connection arrangement being one of an engaging member or a receiving formation, and the respective second connection arrangement being the other of an engaging member or a receiving formation, comprising the steps of positioning the plurality of deck support legs, moving each engaging member into engagement with a respective one of the receiving formations so as to cause the engaging member to engage with the respective receiving formation, such that movement of the deck element relative to the deck support legs is restricted in at least one plane.

The method may further comprise the step of releasably securing each engaging member to its respective receiving formation with which it is engaged using a fastening arrangement.

The method may further comprise the step of inserting a first end of each of the deck support legs into a sleeve of a respective stabilising foot, so as to connect the stabilising foot to the deck support leg.

The method may further comprise the steps of before the step of inserting a first end of each deck support leg into a sleeve of the foot, positioning a connecting sleeve of a respective support member such that it surrounds a portion of the sleeve of the foot, and having inserted the first end of the deck support leg into the sleeve of the foot, aligning a pair of peripherally spaced apertures defined by the connecting sleeve with a pair of peripherally spaced apertures defined by the sleeve of the foot, aligning said apertures with an opening passing through the deck support leg, and engaging a retaining member therethrough.

The method may further comprise the step of positioning a first and a second arm of the support member such that each arm at least partially surrounds a portion of a respective second deck support leg.

Embodiments of the invention will be described by way of example only with reference to the accompanying drawings, of which:—

Figure 3:
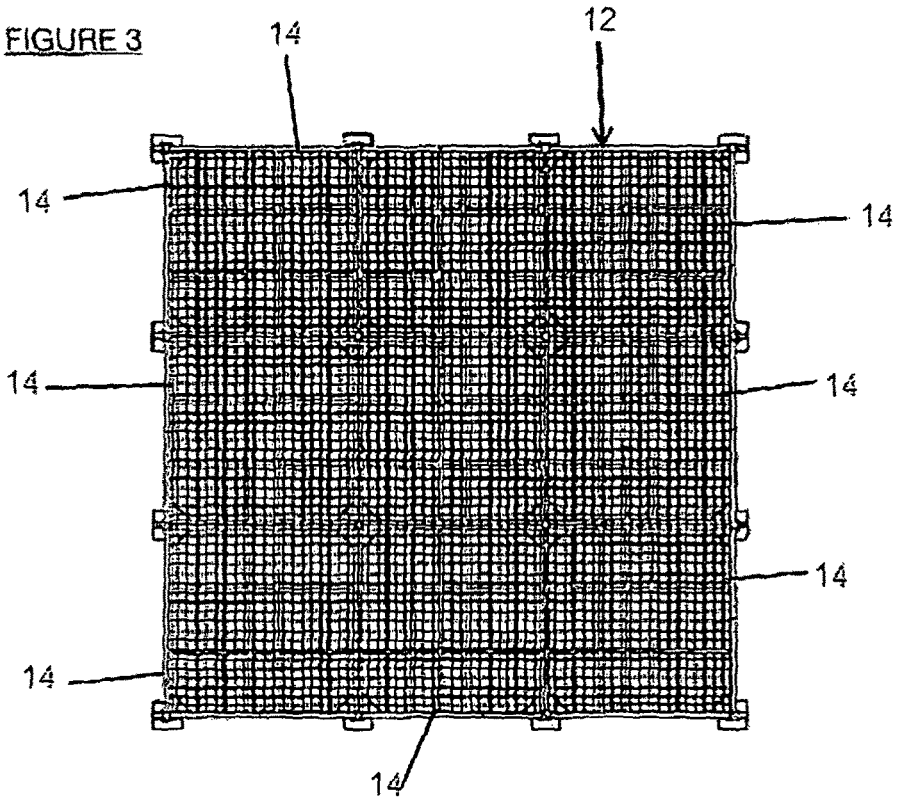
FIG. 3 is a plan view of the modular platform of FIG. 1.
Figure 4:
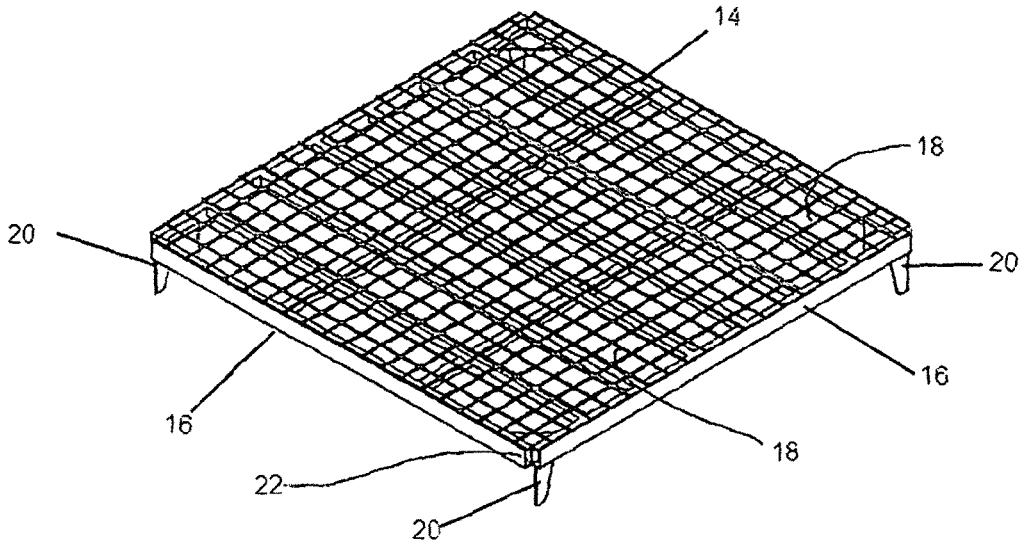
FIG. 4 is a perspective view of a deck element of an embodiment of the invention.

Referring to the figures, a modular platform 10 is shown, comprising a deck surface 12 for supporting workmen, building equipment, materials and the like, to allow the workmen to safely at a level raised from the ground. The deck surface 12 comprises a plurality of deck elements 14 (see FIGS. 3 and 4), each having a load-bearing member (shown generally at 18) and at least one support beam 16. In the examples shown, the deck elements 14 and load-bearing members 18 have a generally square top-down profile, and are each supported by four support beams 16, one disposed along each edge of the load-bearing member 18. Alternatively, one or more of the load-bearing members 18 may have a generally rectangular top-down profile, or that of any regular shape, shapes, or combination of shapes, suitable to fit alongside one another in a modular system. The load-bearing member 18 provides a surface in the form of a grid, rows of bars, or a solid surface. In the example shown in FIG. 4, each load-bearing member 18 comprises a grid of support bars. The load bearing members 18 may be formed of steel, a reinforced plastics material, or any other suitable rigid material.

Figure 5:
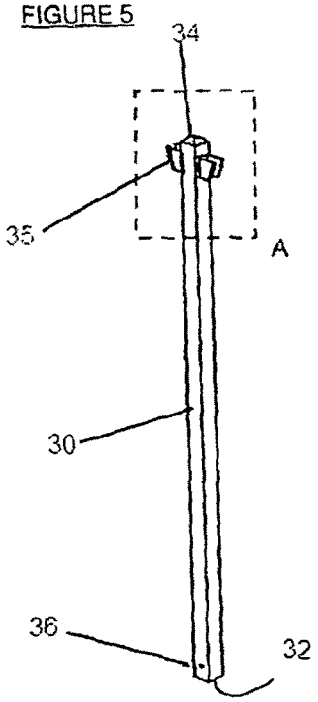
FIG. 5 is a perspective view of a deck support leg of an embodiment of the invention.

Each deck element 14 is configured to be supported at each corner by a respective deck support member. In the described embodiment, each deck support member is a deck support leg 30 (see FIG. 5) disposed generally below the deck element 14. Each deck support leg 30 is an elongate pole of generally square cross-section, having a first or upper end 34 and a second or lower end 32. Alternatively, the deck support legs could have a rectangular, or circular, cross-section.

The deck element 14 comprises four first connection arrangements 20, one disposed adjacent each corner of the load-bearing member 18, extending in a first direction (preferably downward) from the deck element 14. Each first connection arrangement 20, in embodiments, comprises an engaging member having a 'male' part formed as a flat elongate strip 20 that extends outwardly from the lower surface of the deck element 14. The engaging member is configured to engage with a corresponding second connection arrangement 35, disposed adjacent the upper end 34 of a respective deck support leg 30 and coupled thereto.

Figure 6:
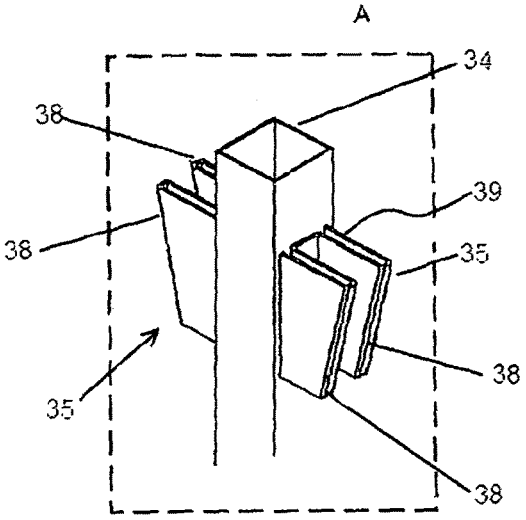
FIG. 6 is an enlarged view of region A indicated in FIG. 5.

Each second connection arrangement 35 comprises a receiving formation 38 (see FIG. 6) that extends from a side of the deck support leg 30. The receiving formation 38, in embodiments, includes pair of generally parallel side walls extending from a surface of the deck support leg 30, and an outer wall generally perpendicular to the plane of the side walls and extending between the side walls along at least a portion of their respective edges, forming a recess extending downward between the two side walls providing a 'female' slot arrangement 39.

In embodiments, movement of a respective engaging member 20 towards the receiving formation 38, in a first 'engaging' direction (preferably, downwards), causes the engaging member 20 to engage the recess 39, and thereby to engage the receiving formation 38, such that movement of the deck element 14 relative to the respective deck support leg 30 is restricted in at least one plane. In the example shown, the deck element 14 may only move in a second direction, opposite to the first engaging direction, relative to the deck support leg 30, once the engaging member 20 and receiving formation 38 are engaged, so as to cause disengagement of the two parts.

While in the example shown, the first connection arrangements 20 are engaging members, and the second connection arrangements 35 are receiving formations, it should be understood that the first 20 and second 35 connection arrangements could be arranged the opposite way around, such that the second connection arrangements 35 are engaging members configured to engage with receiving formations of the first connection arrangements 20. Embodiments may use other forms of connection arrangement 20, 35 to couple the deck element 14 to the deck support leg 30.

Figure 7:
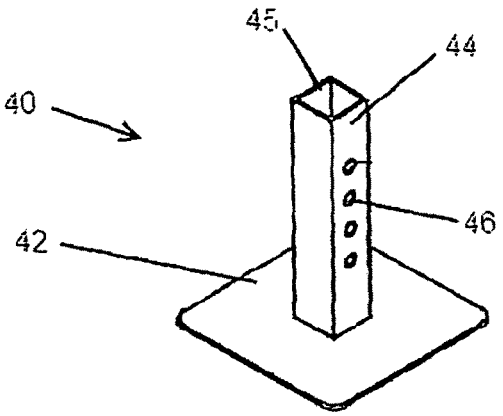
FIG. 7 is a perspective view of a stabilising foot of an embodiment of the invention.

The lower end 32 of each deck support leg 30 is configured to be received by a stabilising foot 40 (see FIG. 7). Each stabilising foot 40 comprises a substantially upright sleeve 44, with an opening 45 at its upper end that is adapted to receive the lower end 32 of a respective one of the deck support legs. The stabilising foot 40 also has, in embodiments, a generally flat stabilising portion 42 that extends outwardly from the sleeve portion 44, generally perpendicular thereto, so as to form a base to support and stabilise the deck support leg 30. The upright sleeve 44 of the stabilising foot 40 may include a plurality of pairs of apertures 46, provided on opposite sides of the upright sleeve 44. At least one aperture 36 is provided adjacent the lower end 32 of each deck support leg 30, through the width of the leg, which may be aligned with a pair of the apertures 46 in the upright sleeve 44. A retaining member (not shown) such as a bolt or pin, for example, may be inserted through the aligned apertures in the deck support leg 30 and stabilising foot 40, so as to hold the lower end of the deck support leg 30 relative to the stabilising foot 40.

By providing a plurality of apertures 46 in the upright sleeve 44 (or alternatively by providing a plurality of apertures spaced vertically from each other through the deck support leg 30), a user assembling the deck support leg 30 may select a height at which to connect the deck support leg 30 to the stabilising foot 40, by choosing which of the apertures to align before inserting the retaining member.

It should be understood that while in the current example pairs of apertures 46 are provided, so that a retaining member such as a bolt may be inserted through the entire width of the deck support leg 30, apertures 46 could alternatively be provided on one side only of the upright sleeve 44, such that the retaining member is partially inserted into the leg 30. Furthermore, the aperture 36 (or apertures) in each deck support leg 30 may extend through only a portion of the width of the deck support leg 30, rather than through the entire width of the leg 30.

Figure 11:
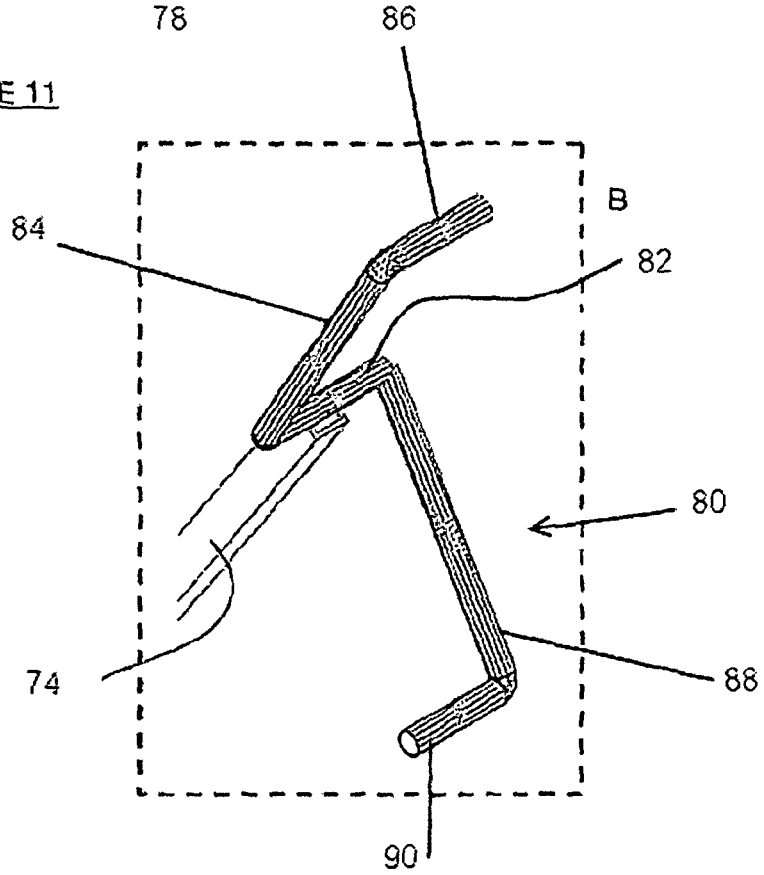
FIG. 11 is an enlarged view of region B indicated in FIG. 10.
Figure 12:
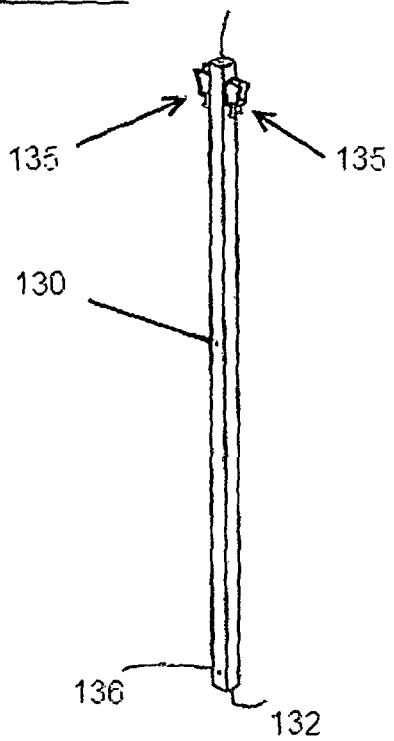
FIG. 12 is a perspective view of a deck support leg according to an alternative embodiment of the invention.
Figure 13:
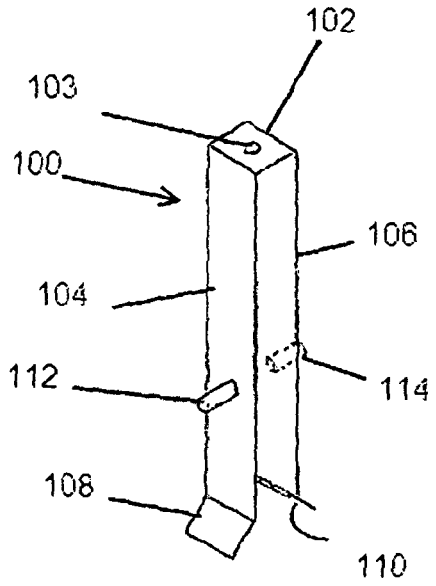
FIG. 13 is a perspective view of a securing member according to the alternative embodiment of FIG. 12.

The platform 10 may further include one or more support members 70 (see FIG. 11) having an elongate body with a first end 72 and a second end 74. The support members 70 form stabilising cross-supports, each end of the support member 70 being configured to be connected to a different one of the deck support legs 30, to brace the deck support legs 30 relative to one another, thereby providing structural support to the platform 10. The first end 72 of the support member 70 includes a first securing arrangement configured for securing the first end 72 of the support member 70 relative to a first one of the deck support legs 30 and the second end 74 of the support member includes a second securing arrangement 80 for securing the second end 74 of the support member 70 relative to a different second one of the deck support legs 30.

The first securing arrangement may comprise a connecting sleeve 78 that is configured to surround a portion of a lower end 32 of the first deck support leg 30. The connecting sleeve 78 is configured, in embodiments, to be fitted over the upright sleeve 44 of a stabilising foot 40, so as to receive a portion of the sleeve 44. The connecting sleeve 78 includes a pair of peripheral apertures 76 which may be aligned by a user, so that the apertures 46 in the upright sleeve 44 align with those apertures 76 and with the aperture 36 through the deck support leg 30, so as to receive the retaining member to secure the deck support leg 30, the stabilising foot 40, and the support member 70 relative to each other.

The second securing arrangement 80 may comprise a pair of arms adapted to surround partially a portion of the respective second deck support leg 30. The second securing arrangement 80 comprises a first arm and a second arm, each arm being fixed substantially rigidly to opposing ends of a cross member 82 disposed generally perpendicular to a longitudinal axis of the body of the support member 70 (to form a T-shaped configuration). The first arm comprises a first portion 84 disposed generally outwardly from the body of the support member 70 in a direction generally parallel to the longitudinal axis of support member 70, and a second portion 86 forming a substantially rigid elbow joint with the first portion 84 such that the second portion 86 is disposed generally perpendicular to the first portion 84 (and generally parallel to a longitudinal axis of the cross member 82). The second portion 86 of the first arm extends from the first portion 84 of the first arm generally toward the second arm. Similarly, the second arm comprises a first portion 88 disposed generally outwardly from the support member 70, and inclined relative to the first portion 84 of the first arm, and a second portion 90 forming a substantially rigid elbow joint with the first portion 88 such that the second portion 90 is disposed generally perpendicular to the first portion 88 (and generally parallel to the longitudinal axis of the cross member 82), extending from the first portion 88 of the second arm generally toward the first arm.

In use, the second securing arrangement 80 may be positioned relative to a deck support leg 30 by a user, such that the cross member 82 abuts a first side of the deck support leg 30 and the first portions 84, 88 of each of the first and second arms lie adjacent and abut against respective opposite sides of the deck support leg 30. The second portions 86, 90 of each of the first and second arms lie adjacent a second side of the deck support leg 30 that is opposite to the first side. In this manner, each arm surrounds a portion the perimeter of the second deck support leg 30, one arm wrapping clockwise around two sides of the leg, the other arm wrapping anticlockwise around two sides of the leg, so that the second portions 86, 90 of the arms are disposed along a length of the second support member 70 against the second side, opposite to that abutted by the cross member 82, so as to hold the support member 70 relative to the deck support leg 30.

In order that the second portion 86, 90 of each arm lies adjacent the second side of the deck support leg 30, each first portion 84, 88 must extend a distance along the axis orthogonal to each of the planes defined by the surfaces of the first and second sides, that is substantially equal to the width of the deck support leg 30.

The second portion 86, 90 of each of the first arm and second arm may comprise a frictional sleeve, made of rubber or another material providing a high frictional coefficient when in contact with a deck support leg 30 constructed from steel, or the like. The frictional sleeves provide a surface for abutting a portion of the second deck support leg 30 so as to resist relative movement between the arm and the deck support leg 30 in a direction axially of the second deck support leg 30.

In embodiments, one or more of the elbow joints and/or connections between the cross member 82 and the first and second arms may be resiliently biased into the described configuration such that attachment of the second securing arrangement 80 to a support leg 30 requires the application of a force against the bias and the second securing arrangement 80 grips the support leg 30.

The platform 10 may further comprise a plurality of barrier arrangements comprising pairs of support posts 47 (see FIG. 8), each having at its first or lower end 50 a third connection arrangement 56 comprising a portion of reduced width, for engagement with a fourth connection arrangement comprising a recess defined by the upper end of a respective deck support leg 30. The portion of reduced width is configured to fit within the recess at the upper end 34 of each deck support leg 30, so that the support post 47 may be inserted into the top of the deck support leg 30, so that the support post 47 is connected to and supported by the respective deck support leg 30. Above the portion of reduced width 56, a portion of the length of the support post 47 having an increased width 54 may be provided, so as to prevent insertion of the support post 47 beyond a desired length inside the recess.

Figure 1:
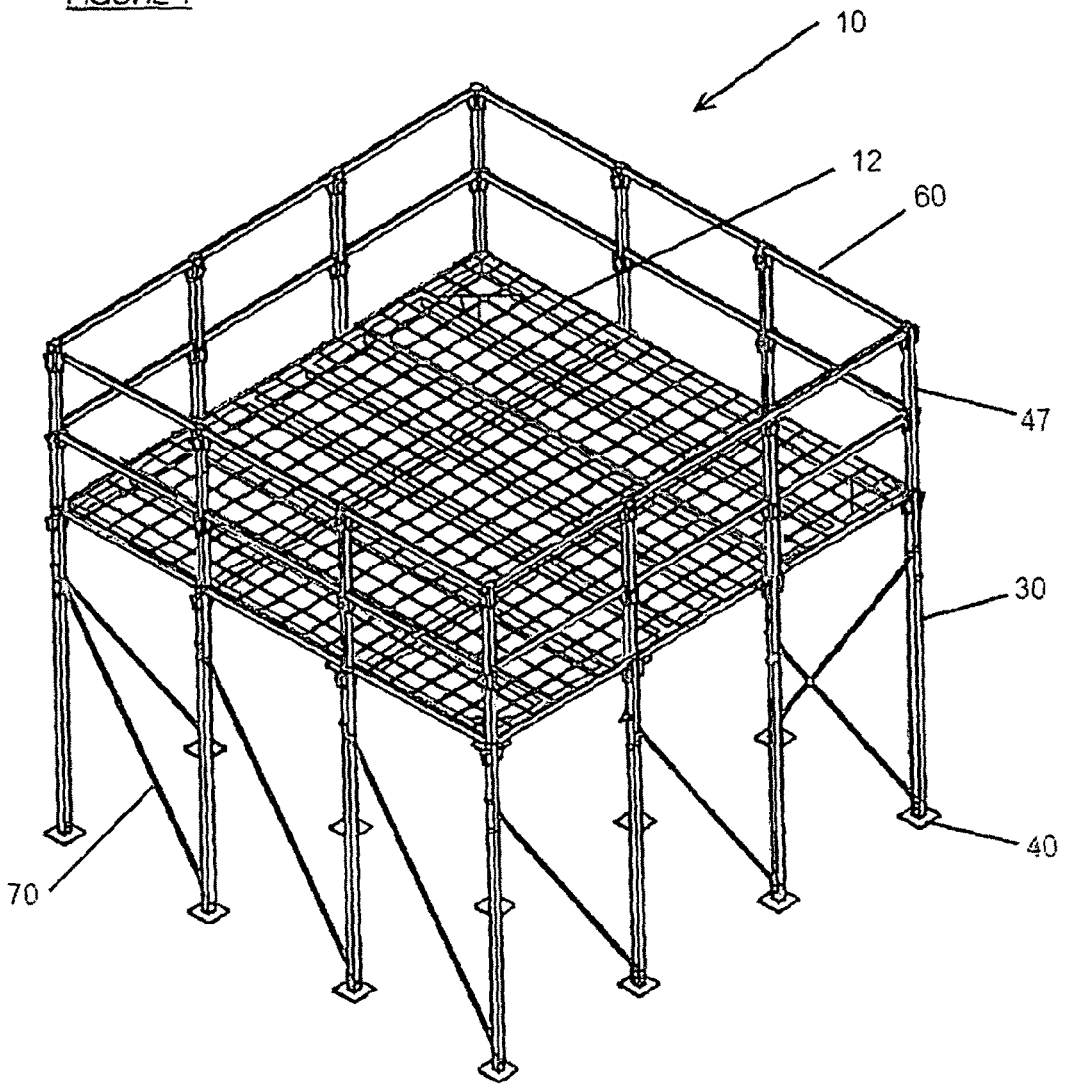
FIG. 1 is a perspective view of an embodiment of a modular platform according to the invention.
Figure 2:
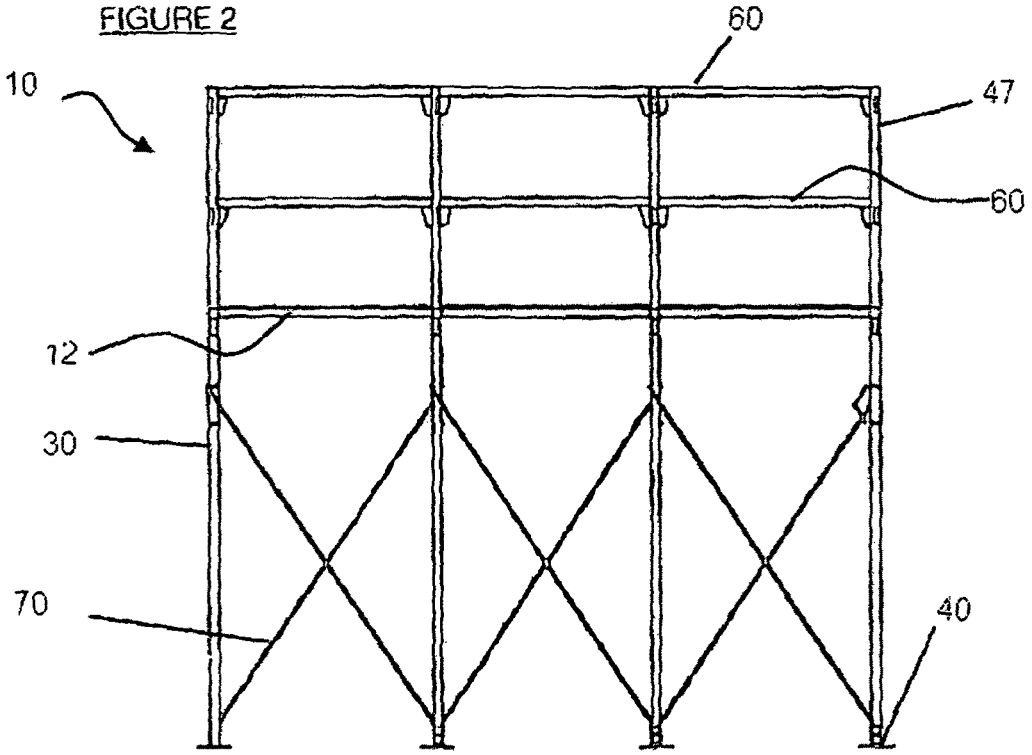
FIG. 2 is a side view of the modular platform of FIG. 1.
Figure 8:
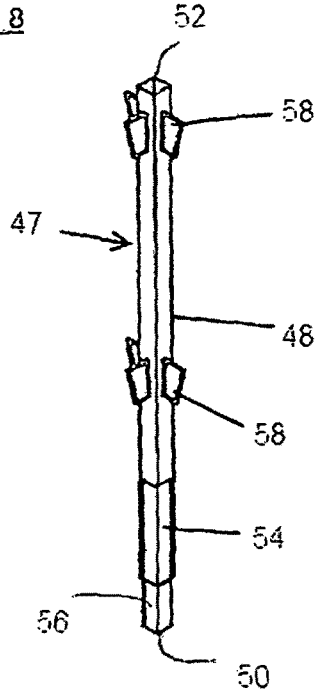
FIG. 8 is a perspective view of a support post of the invention.

One or more fifth connection arrangements 58 may be disposed at a position (or positions) on the support post 47 at a height suitable for supporting a barrier member 60, each fifth connection arrangement 58 extending from a side of the support post 47, having a slot-shaped recess 39 extending downwards from its upper surface. FIGS. 1 and 8 show support posts 47 having fifth connection arrangements 58 disposed at two positions: a first adjacent an upper end 52 of the post, and a second disposed midway along a length of the post. In this way, barriers may be provided at two heights relative to an end of the post 47, to form a safety fence for a user working on the platform, to reduce the likelihood of the user inadvertently falling from an edge of the platform.

Figure 9:
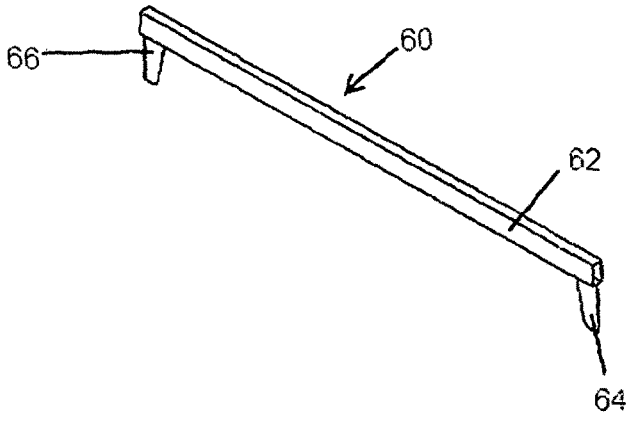
FIG. 9 is a perspective view of a barrier member of the invention.
Figure 10:
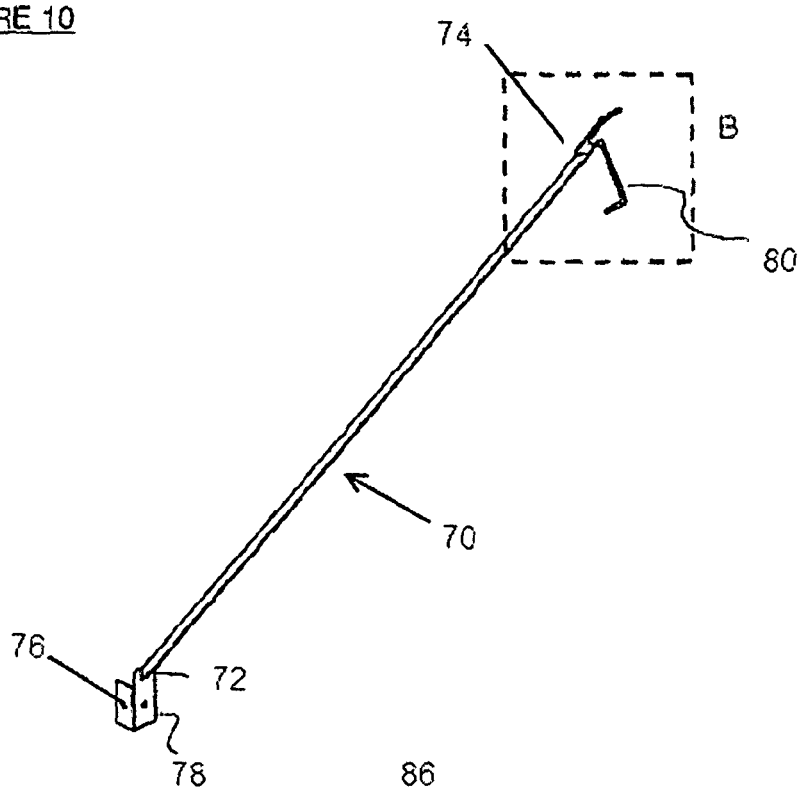
FIG. 10 is a perspective view of a support member of the invention.

Barrier members 60 (see FIG. 9) having a first end 66 and a second end 68 may be provided, each end comprising a sixth connection arrangement 64, 66 for engagement with a respective fifth connection arrangement 58 of a respective one of the support posts 47. The sixth connection arrangements 64, 66 are, in embodiments, 'male' connectors of the same, or a similar, configuration to the engaging members 20 of the deck elements 14, having an engaging part that extends in a first direction (preferably downwards) from a side (preferably an underside) of the barrier member 60. Each barrier member 60 is configured to be connected to and supported by a pair of adjacent support posts 47, as shown in FIG. 1.

The barrier members 60 and deck elements 14 are configured to be connected to support posts 47 and deck support legs 30, respectively, through similar 'male'/'female' connections, between the first and second, and fifth and sixth, connection arrangements. In each case, a protruding 'male' part is received within a 'female' slot part, by moving the deck element 14 or barrier member 60 downwards into engagement. This means that, in use, when a load is applied to the platform, deck element 14 and deck support legs 30 are held engaged with one another.

However, it is preferable that the parts are secured to one another, so that the deck support legs 30 and support posts 47 are unlikely to become inadvertently disconnected from the deck element 14 and barrier members 60, respectively.

Figure 14:
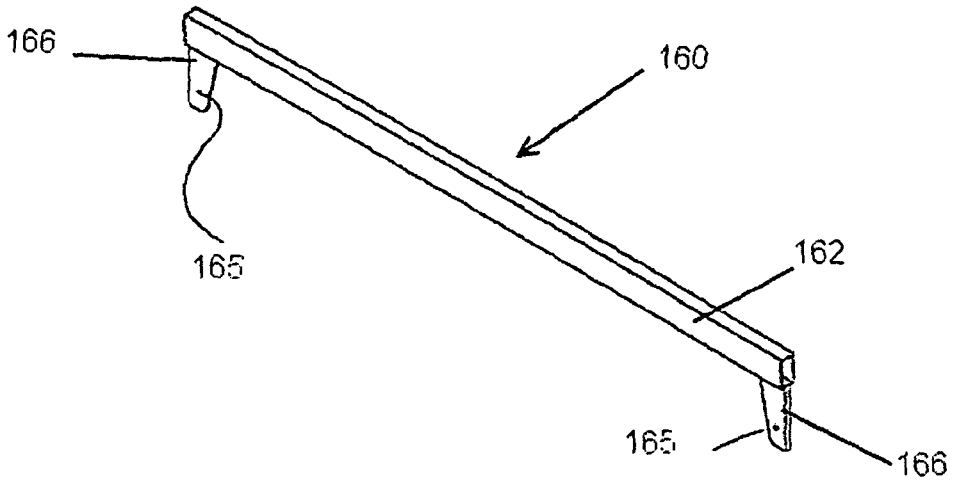
FIG. 14 is a perspective view of a barrier member according to the alternative embodiment of FIGS. 12 and 13.

In an embodiment, as shown in FIGS. 12 to 15, each receiving formation may be provided with a fastening arrangement 100. A fastening member 104, 106 is configured so as to secure releasably an engaging member 166 in engagement with a respective slot arrangement 138. FIG. 14 shows an embodiment of a support beam 160 of a deck element (or alternatively of a barrier member), having engaging members 166 each comprising a generally flat, substantially rigid body, each defining an aperture 165 therethrough for receiving a pin member 112, 114. It will be apparent that the general configuration of a barrier is analogous to the configuration of the support beams surrounding the deck element, providing engaging members for engagement with the receiving formations of the support posts and deck support legs, respectively. For simplicity, the fastening arrangement 100 of the alternative embodiment will be described with reference to connection arrangements between a deck element 14 and a deck support leg 130.

The fastening arrangement 100 of each receiving formation comprises a pair of fastening members 104, 106 each moveable between a 'securing' position and a 'releasing' position. Each fastening member 104, 106 comprises a flexible body, the bodies extending generally parallel one another from an end portion 102, and each having a pin member 112, 114 protruding outwardly from the surface of the respective member.

As shown in the figures, each receiving formation comprises first and second female slot arrangements, disposed generally parallel to one another so as to receive first and second engaging members of adjacent deck elements 14 on a single side of a deck support leg 30. In this way, adjacent corners of up to four deck elements 14, each comprising a respective engaging member, may be supported by a single deck support leg 30, with two engaging members disposed generally parallel to one another may be received on each of two opposite sides of the deck support leg 30, the deck support leg having a total of four slot arrangements.

Each side wall of each female slot arrangement 138 defines an aperture therethrough, and the male part of the respective corresponding engaging member 166 defines an aperture 165 therethrough. A fastening arrangement is provided between each pair of female slot arrangements 138, the fastening members 104, 106 being resiliently biased outwardly, towards respective side walls of the slot arrangements on either side of the fastening arrangement. In this way, the fastening members 104, 106 are each biased to their respective 'securing' positions, wherein the fastening members 104, 106 are disposed generally flat against the respective side walls. The end portion 102 of each fastening arrangement 100 defines an aperture 103 for receiving a screw, a rivet, or the like, for securely attaching the fastening arrangement 100 to a part of the deck support leg 30.

Where a male part of an engaging formation 166 is engaged with the female slot arrangement 138, the aperture 165 through the male part aligns with the apertures in each side wall. The fastening members 104, 106 are configured such that a respective pin member 112, 114 is aligned axially with the apertures so as to extend therethrough when the fastening member 104, 106 is in its 'securing' position thereby securing the male part in engagement with the female slot. The pin member 112, 114 is retracted from within the apertures when the fastening member 104, 106 is in its 'releasing' position, so as to release the male part from the female slot arrangement, and allow the two parts to be disengaged from one another.

The flexible bodies 104, 106 and end portion 103 are formed of a resilient material, such that when one or both of the bodies 104, 106 are moved from their natural position relative to the end portion 103, they are biased to return to their original configuration. The flexible bodies are moveable by a user using a digit to press against the resilient biasing force, so as to release the respective male part from its respective female slot arrangement manually. Outwardly extending end portions 108, 110 may be provided at the lower end of each flexible body, to provide surfaces on which a user may a apply a force, so as to move the fastening members 104, 106 into their 'releasing' positions.

Figure 15:
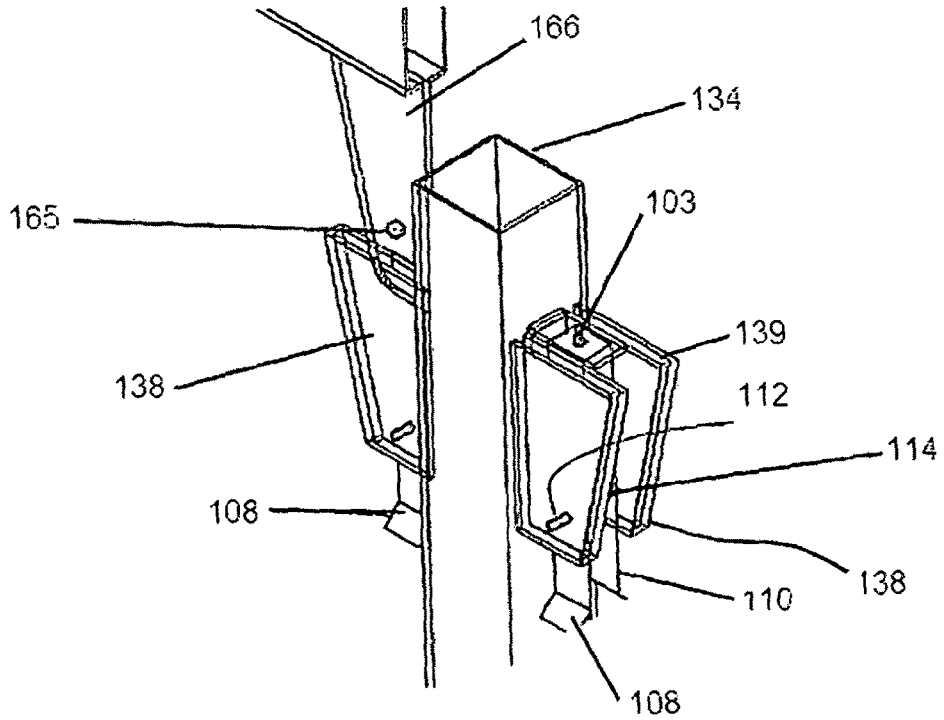
FIG. 15 is a perspective view showing a securing arrangement according to the alternative embodiment of FIGS. 12 to 14.
Figure 16:
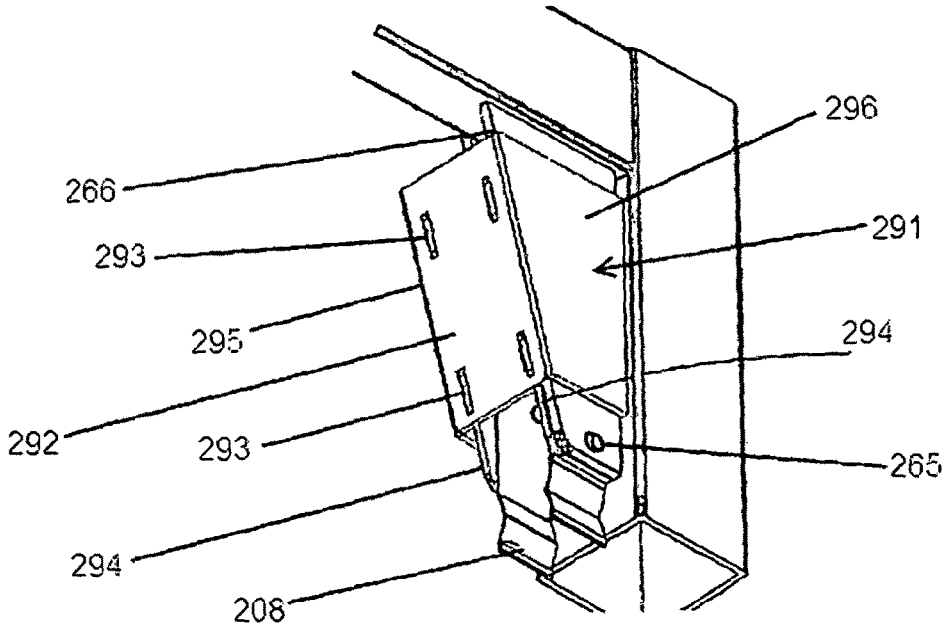
FIG. 16 is a perspective view showing a securing arrangement according to a further alternative embodiment of the invention.

In an embodiment, as shown in FIG. 16, an alternative receiving formation and fastening arrangement is provided. In a manner that is similar to the embodiment of FIGS. 12 to 15, a fastening member is configured so as to secure releasably an engaging member 266 in engagement with a respective slot arrangement. As before, the fastening arrangement of each receiving formation comprises a pair of fastening members each moveable between a 'securing' position and a 'releasing' position, the outwardly protruding pin member of each fastening member engages and extends through an aperture defined by a respective engaging member 266 when the fastening member is in its 'securing' position.

Each receiving formation comprises a housing 291 having first and second side walls 295, 296 disposed generally parallel to one another, and extending outwardly from the surface to which the receiving formation is connected (e.g. a deck support leg). The housing 291 further comprises an outer wall 292 that extends between the first and second side walls 295, 296. The fastening arrangement is disposed between the first and second side walls 295, 296, such that its pin members protrude outwardly from the surface of the respective fastening members.

A pair of internal walls 294 is provided within the housing 291, each internal wall being disposed generally parallel to, and adjacent, a respective side wall 295, 296. The spacing between each side wall 295, 296 and its respective internal wall 294, is approximately equal to the width of an engaging member 266, so that an engaging member 266 may be received with in female slot formation formed between the outer wall 292, a side wall 295, 296, a respective internal wall 294 and the surface to which the receiving formation is attached. Each of the pair of internal walls 294 may be secured relative to the outer wall 292 by engagement of one or more protrusions of the internal side wall 294 with one or more respective slots 293 defined by the outer wall 292.

A similar arrangement may be used to secure the internal walls 294 with respect to the deck support legs.

Each side wall 295, 296 defines an aperture that aligns with a respective pin member, and with an aperture defined in its respective internal wall 294. When a fastening member is in its 'securing' position, its pin member engages and extends through the apertures defined by its respective internal wall 294, and through its respective engaging member 266, so as to hold the engaging member 266 relative to the receiving formation.

To assemble a modular platform according to the invention, the following method may be adopted.

A plurality of deck elements 14 are positioned generally at the positions directly below where they will be required, to establish a footprint of the layout of the platform 10. Deck support legs 30 are positioned generally at the each corner of each deck element 14, a single deck support leg 30 being required to support up to four adjoining corners of deck elements 14.

A stabilising foot 40 is provided at the lower end of each deck support leg 30. A connecting sleeve 78 of a support element 70 is positioned over the upright sleeve 44 of the stabilising foot 40, and the lower end 32 of the deck support leg 30 is receiving within the upright sleeve 44, thereby connecting the deck support leg 30 to the support element 70 and to the stabilising foot 40. The deck support leg 30 is then adjusted to a height at which the upper end of the deck support leg 30 is level with that of the upper ends of adjacent deck support legs 30, so that each corner of each deck element 14 will be supported at approximately the same height, creating a level platform surface.

A retaining member is inserted through the aligned apertures in the stabilising foot 40, the deck support leg 30 and the connecting sleeve 78, thereby securing the deck support leg 30 at the required height from the base of the stabilising foot 40.

Adjacent pairs of deck support legs 30 are secured to one another by support members 70, the first deck support leg 30 being connected to a support member at its first end 72 by its connecting sleeve 78, as described above. The second end 74 of the support member 70 may be positioned relative to the second deck support leg before the deck support leg 30 is connected to its respective stabilising foot 40, by positioning the second securing arrangement 80 such that the cross member 82 abuts a first side of the deck support leg 30. The user then moves the support member 70 relative to the deck support leg 30 so that the first portion 84 of the first arm wraps around a second side of the deck support leg, so that the frictional sleeve of the second portion 86 of the arm lies across a third side of the deck support leg, opposite to the first side. The support member 70 is then moved relative to the deck support leg 30 so that the first portion 88 of the second arm wraps around a fourth side, opposite the second side, the frictional sleeve of the second portion 90 of the second arm lying across the third side of the deck support leg 30. In this manner, the deck support leg 30 is surrounded by the two arms of the second securing arrangement 80. The frictional sleeves rest on the third side of the deck support leg 30, preventing unintentional movement of the support member 70 relative to the deck support leg 30.

Each engaging member of each of the deck elements 14 may then be moved into engagement with a respective one of the receiving formations disposed at the upper ends of the deck support legs 30, so as to cause the engaging members to engage with the respective receiving formations, such that movement of the deck element 14 relative to the deck support legs 30 is restricted in at least one plane.

When assembling a platform 10 according to another of the embodiments of the invention, each engaging member is secured to its respective receiving formation by a fastening arrangement 100—the pin member 112, 114 of each fastening member 104, 106 being biased to its 'securing' position, so that as the apertures in the engaging member and receiving formation side walls align, the pin member 112, 114 extends through the apertures.

A plurality of barrier arrangements, 160, 60 may then be arranged above the deck elements 14. For each barrier 160, 60, a pair of support posts 47 is erected, the lower end 50 of each support post 47 comprising a portion of reduced width 56 which is inserted into a recess disposed at the upper end of a respective deck support leg 30. Above the portion of reduced width 56, a portion having an increased width 54 abuts the upper end 34 of the deck support leg 30, so as to prevent further insertion of the support post 47 inside the recess.

Barrier members 160, 60 are arranged between adjacent pairs of support posts 47, and connected by 'male' engaging connectors at their first end 66 and second end 68 to 'female' slot formations 58 extending from each support post 47. Preferably a first barrier member 160, 60 is provided between the upper ends of the support posts 47, and a second barrier member 160, 60 is provided at a point approximately halfway up the support posts 47. If fastening arrangements are provided on the receiving formations, these may then be secured with retaining members in order to hold the barrier members securely to the support posts 47 at each end.

Figure 17:
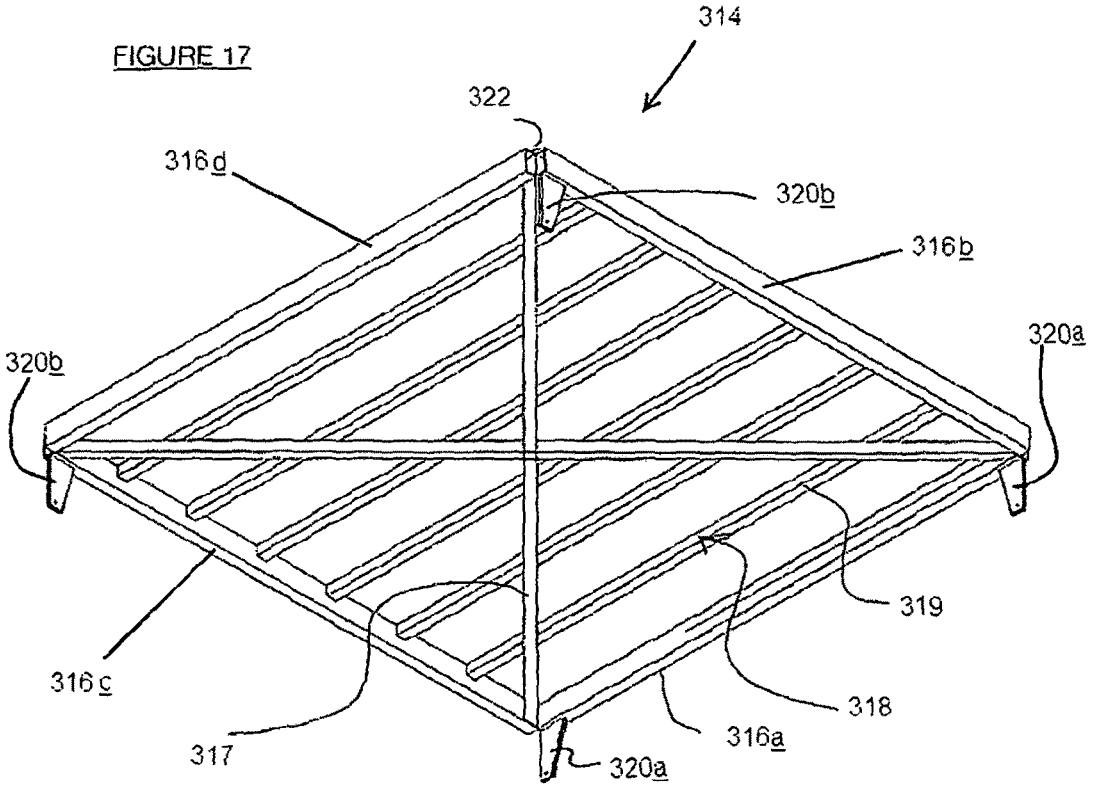
FIG. 17 is a perspective view of the underside of a deck element of an embodiment of the invention.

With reference to FIGS. 17 to 20 of the drawings, further features of embodiments are shown. FIG. 17 shows a deck element 314 supported by four support beams 316, one disposed along each edge of a load-bearing member 318. In the example shown, the load-bearing member 318 comprises a grid of support bars 319, which may be formed of steel, for example. Each load-bearing member 318 may be spaced apart from another load-bearing member 318 by about 140 cm. Each load-bearing member 318 may be spaced apart from another load-bearing member 318 by about 138 cm.

The deck element 314 is configured to be supported with respect to a ground surface (for example) at each corner by a respective deck support member. The deck element 314 comprises four first engaging members 320*a*, 320*b*, one disposed adjacent (or otherwise associated with) each corner of a load-bearing member 318 and extending downward from the deck element 314. A first pair of engaging members 320*a* is disposed on a first one of the support beams 316*a*, so as to align in a common plane, and to extend outwardly from each end of the lower surface of the deck element 314. Each of a second pair of engaging members 320*b* is located on a second and third of the support beams 316*b*, 316*c*, the second and third support beams 316*b*, 316*c* being disposed between and approximately perpendicular to, the first and a fourth of the support beams 316*a*, 316*d*. Each of the second pair of engaging members 320*b* is disposed towards the respective ends of the second and third support beams close to the fourth support beam 316*d*.

As will be appreciated, according to some embodiments, that the engaging members 320*a*, 320*b* include at least one engaging member 320*a* which extends through a plane (e.g. parallel to a longitudinal axis of the first support beam 316*a*) which is generally perpendicular to a plane of extension (e.g. parallel to a longitudinal axis of the second support beam 316*d*) of another of the engaging members 320*b*. This may provide a cross-bracing effect to improve, in some embodiments, load bearing characteristics and/or rigidity.

Figure 18:
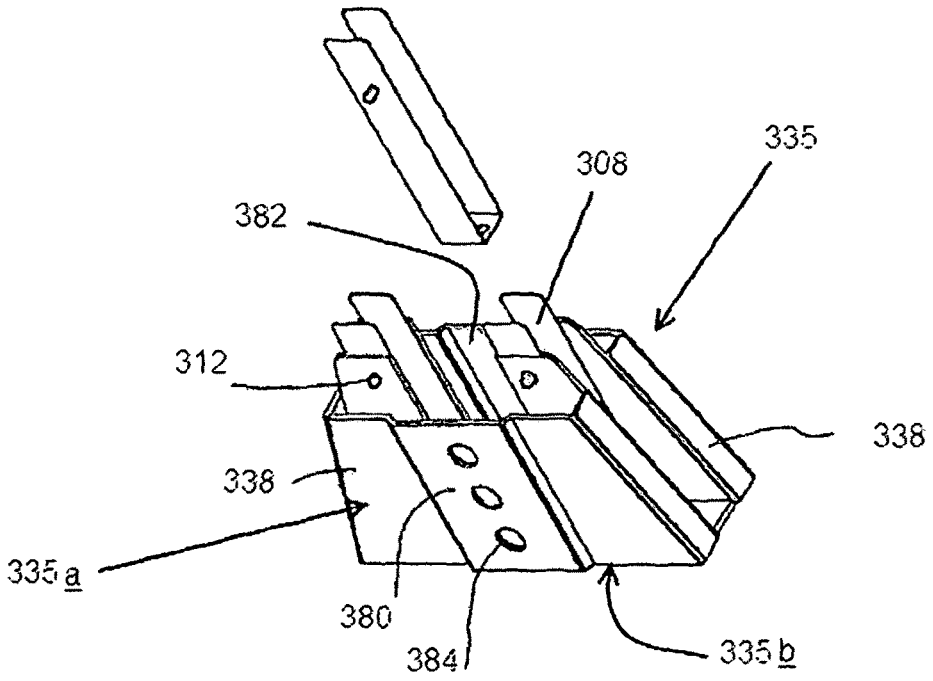
FIG. 18 is a perspective view of a securing arrangement of an embodiment of the invention.

The engaging members 320*a*, 320*b*, and receiving formations with which they engage, may be secured to one another in substantially the same manner as those of the previously described embodiments, as shown in FIGS. 15 and 16. An alternative receiving formation and fastening arrangement is shown in FIG. 18 of the drawings. In a similar manner to the previous embodiments, a fastening member is configured so as to secure releasably an engaging member 320*a*, 320*b* in engagement with a respective slot arrangement. As before, the fastening arrangement of each receiving formation comprises a pair of fastening members each moveable between 'securing' and 'releasing' positions, the outwardly protruding pin member of each fastening member engages and extends through an aperture defined by a respective engaging member when the fastening member is in its 'securing' position.

In embodiments, a receiving arrangement 335 is provided, having a first and a second receiving formation 335*a*, 335*h*. Each receiving formation 335*a*, 335*b* is similar to those of the embodiment shown in FIG. 15, wherein each comprises first and second female slot arrangements, disposed generally parallel to one another so as to receive first and second engaging members of adjacent deck elements 314. The receiving formations 335*a*, 335*b* are connected to one another by a hollow body 380 which is adapted to receive at least partially and/or to surround at least partially a deck support leg 330. The body 380 of each receiving arrangement 335 may be placed over an end of a deck support leg 330 when the leg is moved into position, so that the body 380 forms a sleeve around the leg, and then slid along a length of the leg until it reaches the desired position. Once in position, a securing part, such as a pin, a bolt, or the like, may be inserted through an aperture 384 in the body 380, and through an aperture 331*a* in the deck support leg 330, so as to hold the receiving arrangement 335 relative to the deck support leg 330.

The body 380 may include a plurality of such apertures 384—which may be arranged in pairs with one aperture of each pair being through one of two opposing walls of the body 380 and the other aperture of each pair being through the other of the two opposing walls, the apertures of each pairs being substantially aligned with each other. In an embodiment, two or more apertures 384 (for example, three or more pairs of apertures 384) may be provided such that the position of the position of the receiving arrangement 335 can be fine-tuned with respect to the deck support leg 330 by aligning the aperture 331*a* of the deck support leg 330 with a different one of the two or more apertures 384 through the body 380. The apertures 384 through the body 380 may be such that a pin or bolt (for example) may extend through a first aperture 384 through the body 380, through an aperture 331*a* of the deck support leg 330, through a further aperture 331*a* in an opposing side of the deck support leg 330, and through an aperture 384 in an opposing part of the body 380.

The receiving arrangements 335 are designed such that two receiving formations 335*a*, 335*b* are provided, and the orientation of the receiving arrangement 390 relative to the deck support leg 330 determines the direction in which the receiving formations 335*a*, 335*b* extend outwardly from the leg. In other words, a receiving arrangement 335 may be connected to the leg in one of at least two positions, such that the receiving formations extend North/South, or East/West, respectively (with two opposing parallel sides of the deck support leg 330 represent nominal North and South sides and two opposing parallel sides of the deck support leg 330 represent nominal East and West sides—without limitation to the actual orientation of the deck support leg with respect to, for example, magnetic north). In combination with the configuration of engaging members 320*a*, 320*b* on each of the deck elements 314, this enables a grid of deck elements 314 to be constructed such that neighbouring connection formations, on adjoining deck elements 314, are oriented perpendicular to one another. Such a configuration may result in a more resilient platform structure, in which lateral movement of a particular deck element 314 is not transferred along a column or row of deck elements 314 to the extent it would otherwise be, if the connection formations were all aligned (i.e. a cross-braced effect).

Figure 19:
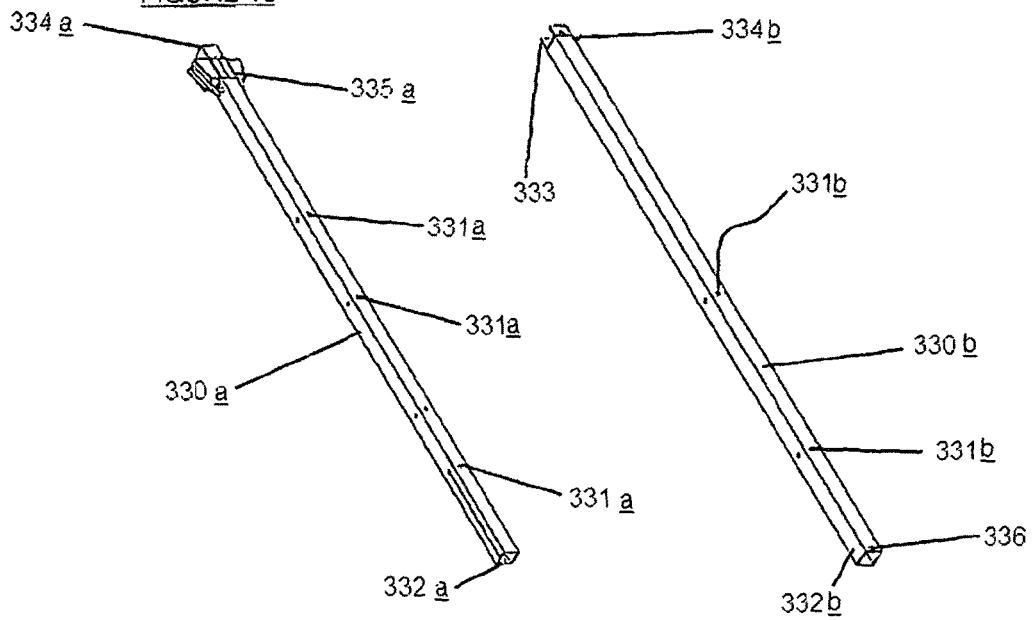
FIG. 19 is a perspective view of an inner support post and an outer support post of an embodiment of the invention.
Figure 20:
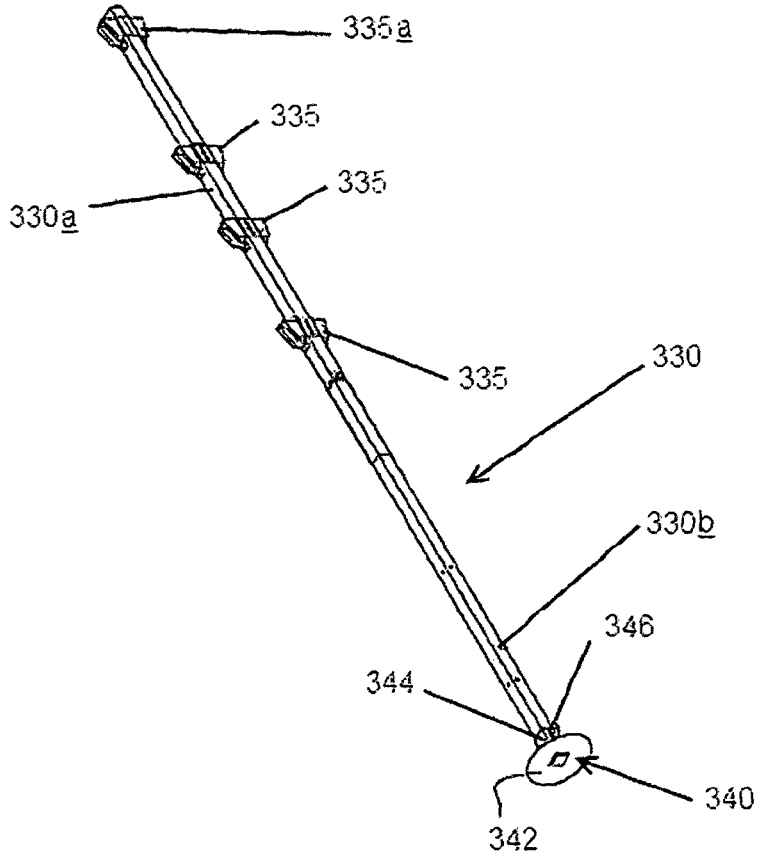
FIG. 20 is a perspective view of a support post of an embodiment of the invention.

FIGS. 19 and 20 show an alternative embodiment of a deck support leg 330, comprising an inner member 330*b*, an outer sleeve 330*a*, and a stabilising foot 340. The inner member 330*b* and outer sleeve 330*b* each comprise an elongate pole of generally square cross-section, having a first or upper end 334*a*, 334*b* and a second or lower end 332*a*, 332*b*. At its upper end 334*a*, the outer sleeve 330*b* may include an integral receiving arrangement 335*c*, having a similar configuration to the receiving arrangements 335 hereinbefore described. Whereas the receiving arrangements 335 hereinbefore described include a body 380 which forms a sleeve to surround a portion of a deck support leg 330, the body of a receiving arrangement 335*c* formed on an outer sleeve may be fixed relative to the sleeve, and may not be removable therefrom (without damage being caused to the deck support leg 330). The receiving arrangements 335*c* need not be integrally formed with outer sleeve 330*b* but may be welded or soldered thereto.

A complete deck support leg 330 may be constructed by inserting a portion of the inner member 330*b* inside the outer sleeve 330*a* which is substantially hollow, so that the inner member 330*b* and outer sleeve 330*a* slidably engage one another—i.e. "telescope" with respect to each other. The inner member 330*b* and outer sleeve 330*a* may be moved axially relative to one another to a configuration in which one or more apertures 331*a*, 331*b* provided in each, respectively, is in alignment. When in alignment, the apertures 331*a*, 331*b* may receive a bolt or pin, so as to hold the inner member 330*b* and outer sleeve 330*a* relative to one another. As will be appreciated a plurality of such apertures 331*a* and 331*b* may be provided such that the overall length of the deck support leg 330 can be adjusted to any one of a plurality of discrete lengths as determined by the positions of the apertures 331*a*,331*b*.

Figure 22:
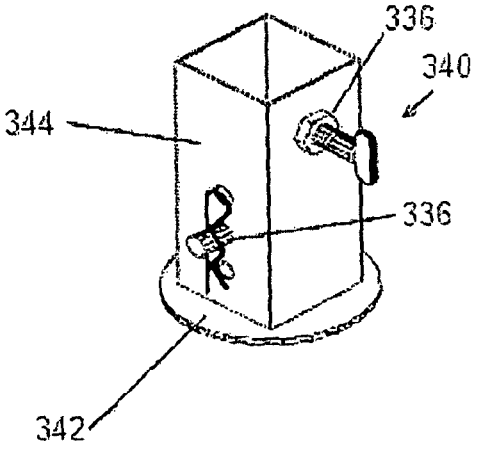
FIG. 22 is a perspective view of a stabilising foot of an embodiment of the invention.

The lower end 332*b* of the inner sleeve 330*b* is configured to be received by a stabilising foot 340. An example of a stabilising foot 340 of an embodiment is shown in FIG. 22. Each stabilising foot 340 comprises a substantially upright sleeve 344, with an opening adapted to receive the lower end 332*b* of a respective inner sleeve 330*b* of a deck support leg. The stabilising foot 340 also has, in embodiments, a generally flat stabilising portion 342 that is configured to support and stabilise the deck support leg 330. The stabilising portion 342 may extend radially outwardly from the sleeve portion 344, generally perpendicular thereto, so as to form a substantially round base to support and stabilise the deck support leg 330 (other base shapes are envisaged such as square, rectangular, pentagonal, hexagonal, and the like). The upright sleeve 344 of the stabilising foot 340 may include a plurality of apertures 346, provided through at least one side of the upright sleeve 344. At least one aperture 336 may be provided adjacent the lower end 332*b* of the inner member 330*b*, through at least a part of the width of the leg, which may be aligned with an aperture 336 in the upright sleeve 344. A retaining member (not shown) such as a bolt or pin, for example, may be inserted through the aligned apertures 331*a*, 331*b* in the deck support leg 330 and stabilising foot 340, so as to hold the lower end of the deck support leg 330 relative to the stabilising foot 340. In other embodiment, the aperture or apertures 346 provided through at least one side of the upright sleeve 344 may be a threaded aperture such that a correspondingly threaded bolt may be received by the aperture 346 and rotated to bear against an outer surface of the inner member 330*b* to hold the upright sleeve 344 with respect to the stabilising foot 340. As will be appreciated, rotation of the bolt in the opposite direction will release the inner member 330*b*. Both a threaded aperture 346 and a non-threaded aperture 346 may be provided through the one or more sides of the upright sleeve 344.

At an upper end 334*b*, the inner member 330*b* may be provided with a pair of locating elements 333, for alignment with a corresponding pair of apertures 331*a* in the outer sleeve 330*a*. The height of the deck support leg 330 can be adjusted by moving the inner member 330*b* axially with respect to the outer sleeve 330*a*, so as to reduce or increase the length of the inner member 330*b* surrounded by the and outer sleeve 330*a*. Apertures 331*a*, 331*b* are spaced along each of the inner member 330*b* and outer sleeve 330*a*, such that where the relative positions of the inner member 330*b* and outer sleeve 330*a* cause apertures 331*a*, 331*b* to align with one another, a pin or bolt may be inserted through the apertures so as to hold the inner member 330*b* and outer sleeve 330*a* axially relative to one another.

It will be understood that the relative position of the inner member 330*b* and outer sleeve 330*a* may be reversed such that a free end of the outer sleeve 330*a* is the upper end and the stabilising foot 340 may be attached to a free end of the inner member 330*b*.

Figure 21:
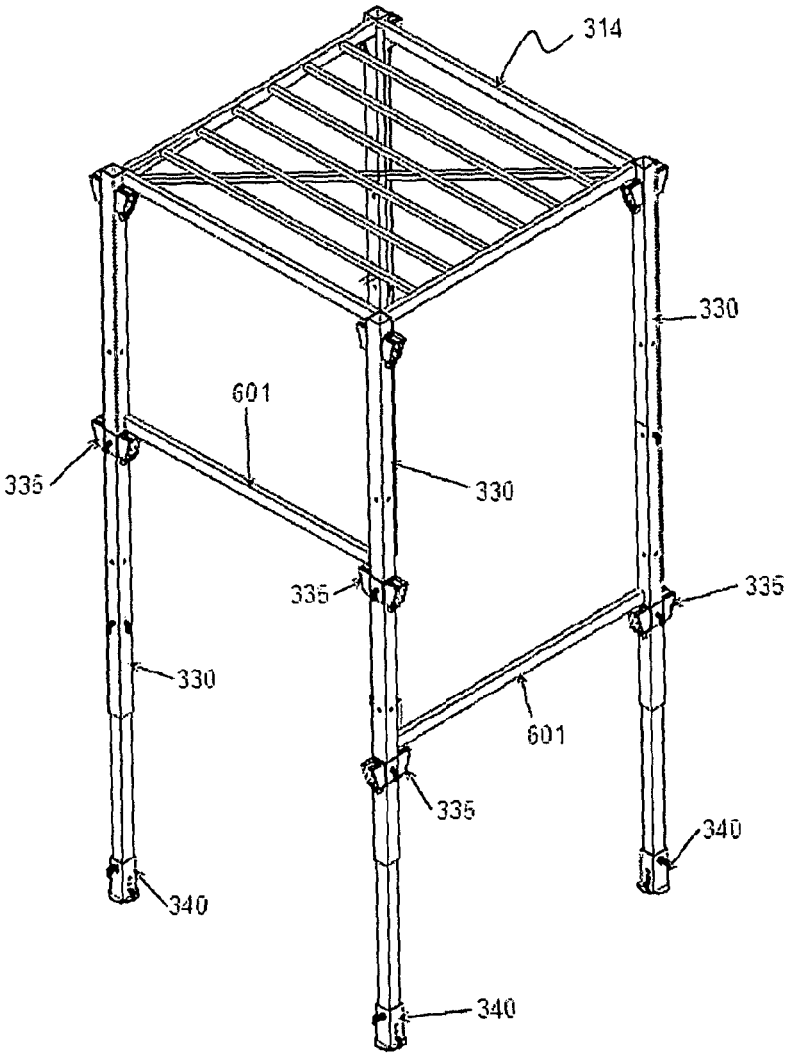
FIG. 21 is a perspective view of an embodiment of the invention.

With reference to FIG. 21, a deck support leg 330 of an embodiment may be braced with respect to another deck support leg 330 using one or more beams 601—substantially identical form to the barrier member 60 discussed above. The or each beam 601 may be secured between two deck support legs 330 using, for example, a pair of receiving arrangements 335 (one receiving arrangement 335 being secured to each deck support leg 330 substantially as herein described along a length thereof).

In embodiments, the outer sleeve 330*a* may have a length of about 180 cm and the inner member 330*b* may have a length of about 150 cm.

One or more of the bolts or pins described herein may be provided with a split pin (which may be in the form of an R-clip) which is configured to be received by an aperture through a diameter of the or each bolt or pin to prevent removal of the bolt or pin.

According to an embodiment, the first connection arrangements may be configured such that a plane of at least one of the first connection arrangements extends in a different direction to a plane of at least one other of the first connection arrangements. The directions of extension may be substantially perpendicular to each other.

According to an embodiment, the engaging members may be configured such that a plane of at least one of the engaging members extends in a different direction to a plane of at least one other of the engaging members. The directions of extension may be substantially perpendicular to each other.

According to an embodiment, the deck support members may each comprise two members configured for telescopic movement with respect to each other such that the overall length of the deck support members can be adjusted. An arrangement may be provided to fix the two members with respect to each other in any one of a discrete number of positions. The arrangement may comprise a pin or bolt configured to pass through apertures in the two members.

According to an embodiment, the second connection arrangement comprises a bracket which is configured to receive at least part of a deck support member such that the bracket is fixable at a plurality of different positions along a length of the deck support member. The bracket may include a plurality of receiving arrangements. The plurality of receiving arrangements may include at least two receiving arrangements which extend in opposing directions. Each receiving arrangement may be configured to engage a first connection arrangement.

According to an embodiment, the receiving formation comprises a bracket which is configured to receive at least part of a deck support member such that the bracket is fixable at a plurality of different positions along a length of the deck support member. The bracket may include a plurality of receiving arrangements. The plurality of receiving arrangements may include at least two receiving arrangements which extend in opposing directions. Each receiving arrangement may be configured to engage a respective engaging member of a deck element.

Figure 23:
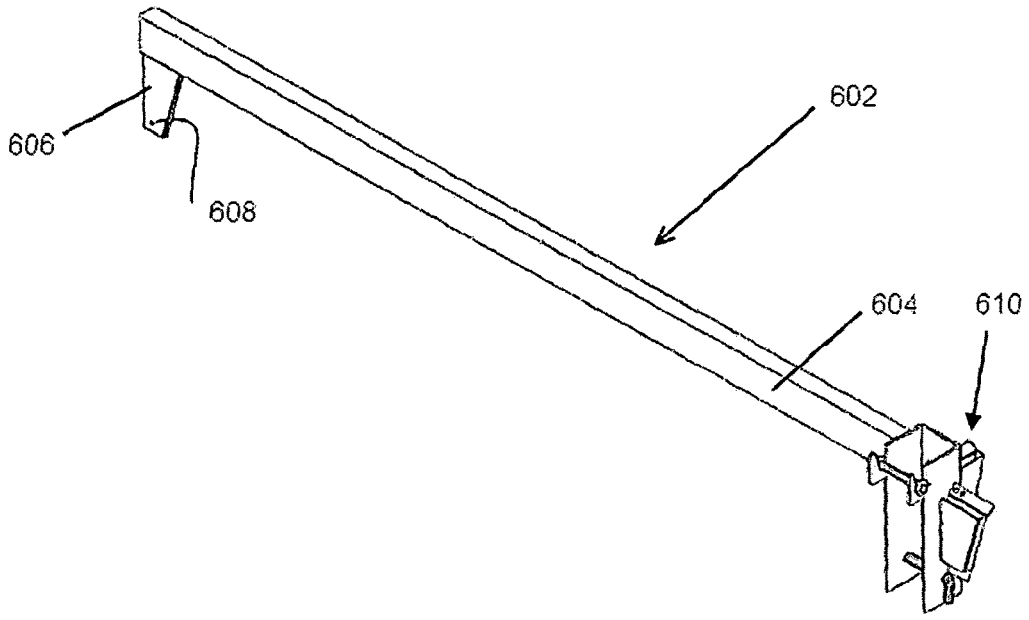
FIG. 23 is a perspective view of a beam of an embodiment of the invention.

According to embodiments, barrier members 60, 160, beams 601, and support beams 16, 316 (that form the edge of load-bearing members 18, 318) may have an alternative form, as shown in FIG. 23. For the sake of simplicity, an alternative form of beam 601 will be described by way of example, but it should be understood that the alternative beam 601 may also form barrier members and support beams. The beam 601 comprises an elongate body 604 having at its first end a 'male' connector 606 (analogous to the engaging members 20 of the deck elements 14) providing an aperture 608. At its second end, the beam 601 comprises a sleeve arrangement 610, for engaging a portion of a deck support leg 30, 330.

Figure 24:
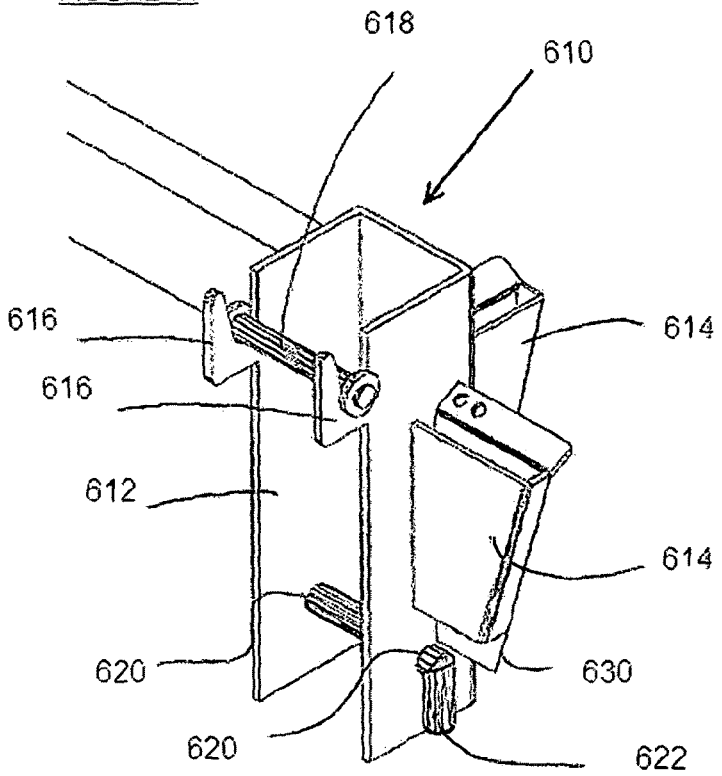
FIG. 24 is a perspective view of a sleeve arrangement of the beam of FIG. 23.

With reference to FIG. 24, the sleeve arrangement 610 comprises a sleeve portion 612 formed of at least three walls, having a C-shaped cross-section, adapted to surround at least partially a portion of the deck support leg 30, 330. As shown in FIG. 24, where a sleeve portion 612 has only three walls, a securing mechanism may be provided having a retaining formation 616 for receiving a retaining bar 618, bolt, pin, or the like, so that the bar 618 is disposed across the fourth side of the deck support leg 30, 330 (that which is not surrounded by a wall) so as to surround the deck support leg 30, 330. The retaining formation 616 may comprise a pair of arms forming a 'U'-shaped slot for receiving the bar 618, and the bar 618 may have a rim of increased diameter at each end, the rims being wider than the slots of the retaining formation 616, so that the bar 618 is substantially prevented from axial movement. Of course, it should be understood that while a bar and slot configuration is described, alternative securing mechanisms may be provided, such as a latching mechanism.

Figure 25:
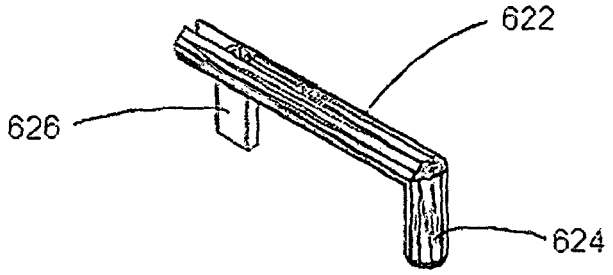
FIG. 25 is a perspective view of a locking bolt of an embodiment of the invention, in a first configuration.
Figure 26:
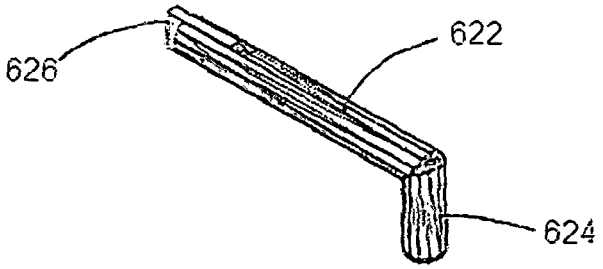
FIG. 26 is a perspective view of a locking bolt of an embodiment of the invention, in a second configuration.

A pair of apertures 620 may be defined by opposite walls of the sleeve arrangement 610, for alignment with corresponding apertures provided in the deck support leg 30, 330, for insertion of a pin, bolt, or the like. With reference to FIGS. 25 and 26, a locking bolt 622 may be provided for engagement with the apertures 620. The locking bolt 622 has a substantially L-shaped body, forming a stopper 624 for abutting a wall of the sleeve arrangement 610 upon full insertion of the locking bolt 622 through the aperture. At its other end, the locking bolt 622 comprises a retaining arm 626 that is pivotably engaged with the body of the bolt, such that it is moveable between a first position (shown in FIG. 25) in which the retaining arm 626 is substantial axially aligned with the body of the locking bolt 622, and a second position (shown in FIG. 26) in which the retaining arm 626 is substantially perpendicular to the axis of the bolt 622. Upon fully insertion of the locking bolt 622 through both apertures 620 in the sleeve arrangement 610, and through an aligned bore or pair of aligned apertures through a deck support leg 30, 330, the retaining arm 626 may be moved from its first position to its second position, so as to provide a degree of resistance to disengagement of the locking bolt 622 through the apertures 620.

In embodiments, at least one wall 612 of the sleeve arrangement 610 provides a 'female' slot arrangement 614 which may be of the same form as the slot arrangements 39, 139 of previously-described embodiments, or any other embodiments described herein. As shown in FIG. 24, the slot arrangement 614 may comprise a housing adapted to receive a male connector 606, such that when fully inserted into the housing, an end portion of the male connector 606, providing the aperture 608, extends through the housing. A resiliently-deformable tab 630 may extend from a wall of the housing, providing a pin for engagement with the aperture 608 of a male connector 606, such that on insertion of a male connector 606 into the slot arrangement 614, the tab 630 deforms by flexing outwardly as the end of the male connector 606 abuts the pin. When the male connector 606 is fully inserted, the pin aligns with aperture 608, and the tab 630 moves back to its original position such that the pin engages the aperture 608 so as to hold the male connector 606 in engagement with the female slot arrangement 614.

Figure 27:
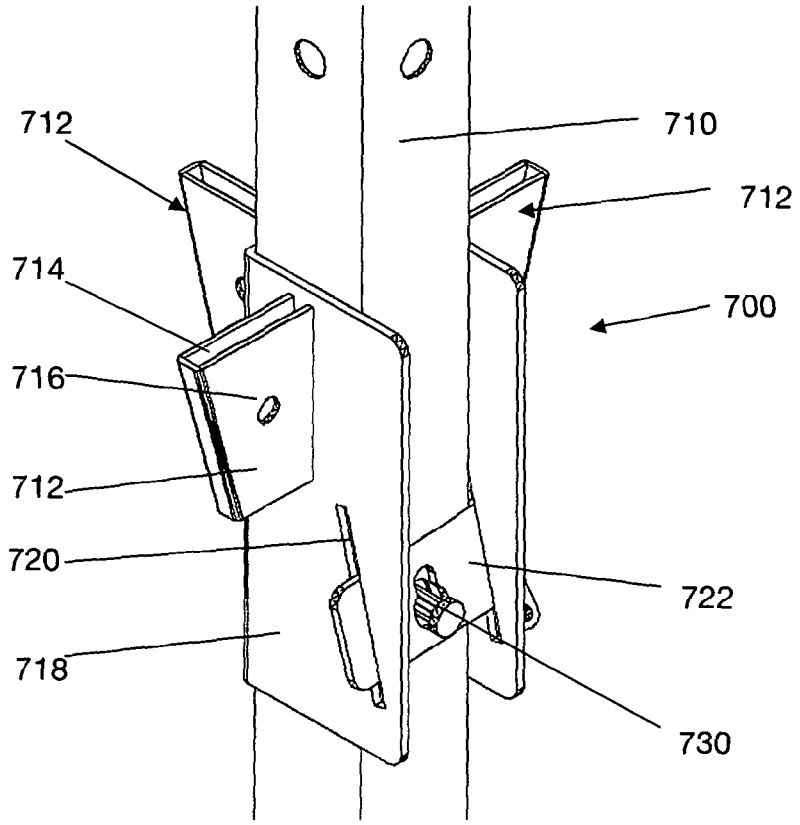
FIG. 27 is a perspective view of a sleeve arrangement according to embodiments of the invention.
Figure 28:
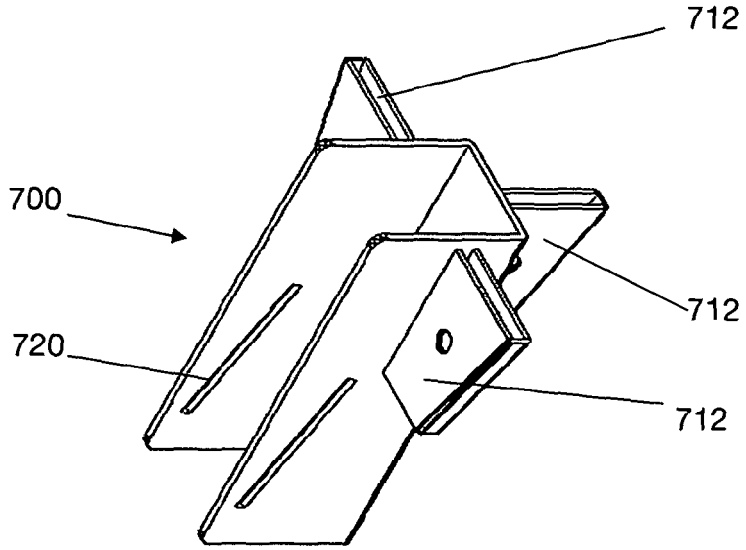
FIG. 28 is a perspective view of the sleeve arrangement of FIG. 27.
Figure 29:
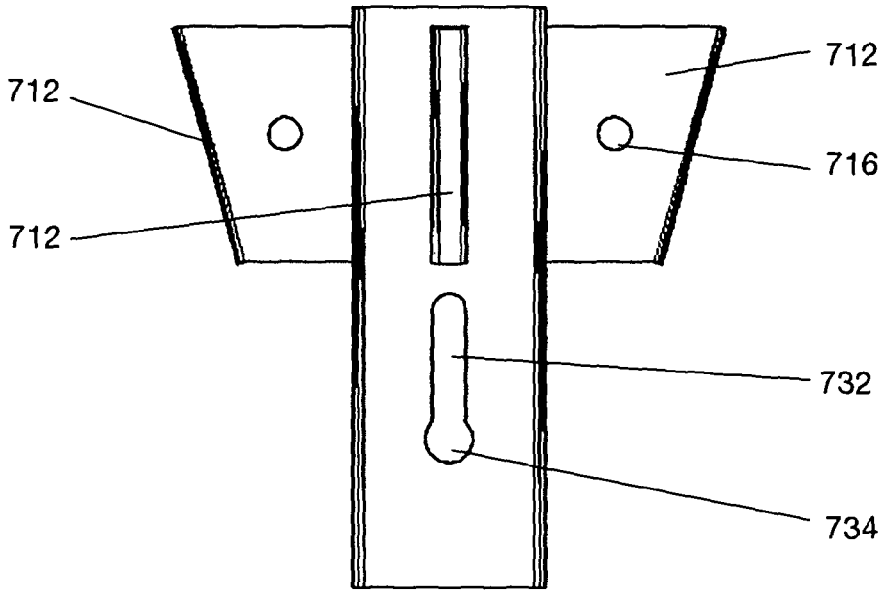
FIG. 29 is a side view of the sleeve arrangement of FIG. 27.
Figure 30:
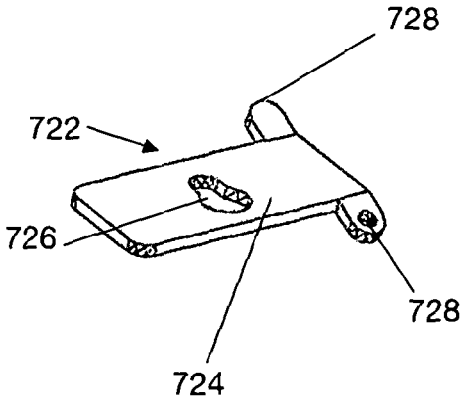
FIG. 30 is a perspective view of a latch member of embodiments of the invention.
Figure 31:
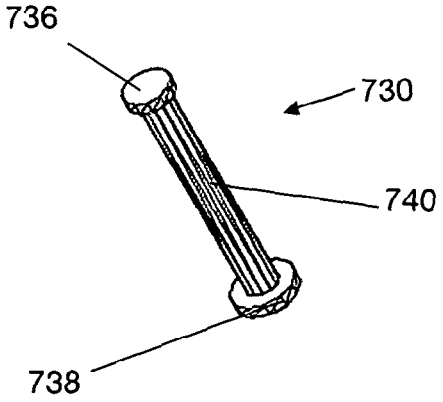
FIG. 31 is a perspective view of a bolt operable to engage the latch member of FIG. 30.

In embodiments, an alternative sleeve arrangement 700 is provided, aspects of which are shown in FIGS. 27 to 31. The sleeve arrangement 700 comprises a sleeve portion 718 (or at least a partial sleeve) with a generally C-shaped cross-section forming a C-shaped channel. The sleeve portion 718 is adapted to abut three of the four sides of a deck support leg 710 in a similar manner to that of a sleeve arrangement of the embodiment shown in FIG. 26. At least one wall of the sleeve arrangement 718 provides a 'female' slot arrangement 712 which may be of form of any appropriate slot arrangement of the embodiments described herein. As shown in FIGS. 27 to 29, the sleeve arrangement may comprise three female slot arrangements 712 (one female slot arrangement 712 being associated with each wall of the sleeve arrangement 718). Each side wall of the female slot arrangements 712 may define an aperture therethrough, and the male part of a respective corresponding engaging member may define an aperture therethrough, such that when the male part is engaged with the female slot arrangement 712 the aperture through the male part aligns with the apertures defined by each side wall of the female slot arrangement 712. The male part of the engaging member may be comprised by a beam 601, a barrier member 60 a support beam 16, or the like.

A bolt or the like may be inserted through the aligned apertures to secure the male part and female slot arrangement 712 relative to one another. Alternatively, rather than the male part defining an aperture, a pin member may extend outwardly from the male part so as to protrude through one or more apertures in the walls of the female slot when the male part is inserted into the female slot arrangement 712, to resist disengagement of the male part from the female slot arrangement 712. As in previous embodiments, the pin member may be retracted from within the aperture to release the male part from the female slot arrangement 712, either by applying a sufficient force to the male part or to the pin member itself.

The sleeve arrangement 700 defines a pair of slots 720, as shown in FIGS. 27 and 28, lying opposite one another adjacent either end of the C-shaped portion. When the sleeve arrangement 700 is positioned around a portion of a deck support leg 710, the portions of the sleeve arrangement 700 defining the pair of slots 720 are positioned away from the deck support leg 710, so that a latch member 722 may be inserted through both slots 720. At an end of the latch member 722 an abutment formation 728 is provided to prevent that end of the latch member 722 from being inserted through either slot 720. The latch member 722 defines an aperture 726 through its body 724, for receiving an end of a bolt 730. The aperture 726 has a wide lower portion having a width sufficient to receive a first head 738 of the bolt, and a narrow upper portion with a width sufficient to accommodate the diameter of the body 740 of the bolt, such that the first head 738 of the bolt 730 may be inserted through the wide lower portion of the aperture 726, and the latch member 722 may then be moved downwardly relative to the bolt 730 so that the body 740 of the bolt lies within the narrow upper portion of the aperture 726. In this configuration, the first head 738 is too wide to pass through the upper portion of the aperture, and thus the latch member 722 is held between the first head 738 of the bolt 730 and a side of the deck support leg 710.

The end of the bolt opposite to the first head 738, having a second head 736, is insertable through an aperture through the width of the deck support leg 710, for engagement with an aperture in a wall of the sleeve arrangement 700. The aperture in the sleeve arrangement 700 has a wide lower portion 734 and a narrow upper portion 732, such that the second head 736 of the bolt may pass through the wide lower portion 734 of the aperture. Movement of the sleeve arrangement 700 downwards relative to the bolt 730 causes the second head 736 of the bolt 730 to move to the upper portion 732 of the aperture, in which the second head 736 is too wide to pass through the aperture. In this manner the bolt 730 and latch member 722 may be used to secure the sleeve arrangement 700 in a vertical position relative to the aperture through the deck support leg 710, and to prevent the sleeve arrangement 700 from lateral disengagement from the deck support leg 710.

It should be understood that while in the embodiments described, the bolt 730 has a first head 738 that is shown to have a larger diameter than the second head 736, the two heads may have similar or the same diameter as each other, or alternatively the first head 738 may have a smaller diameter than the second head 736. As it will be understood, the bolt 730 need not be a threaded bolt and the first and second heads 738, 736 may be fixedly secured to the body 740 of the bolt 730.

Figure 32:
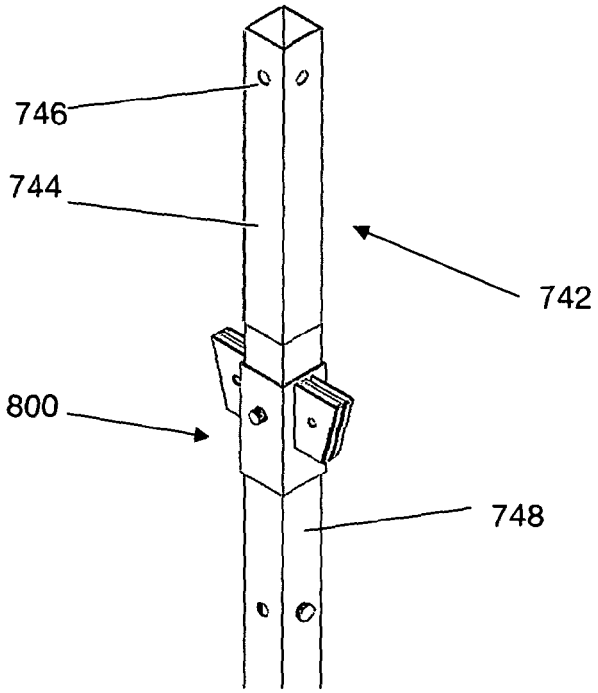
FIG. 32 is a perspective view of an extension element shown in engagement with a deck support leg.
Figure 33:
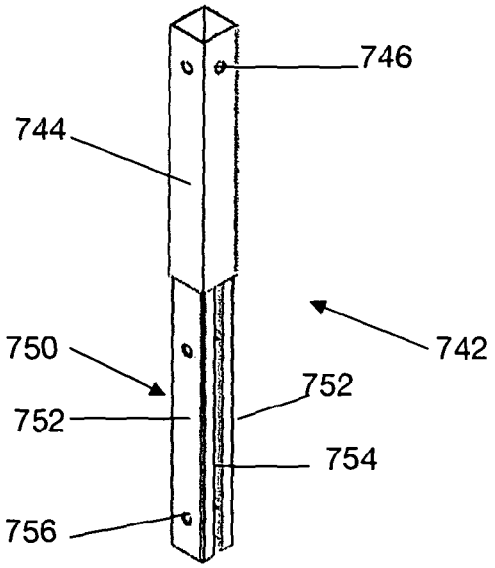
FIG. 33 is a perspective view of the extension element of FIG. 32.
Figure 34:
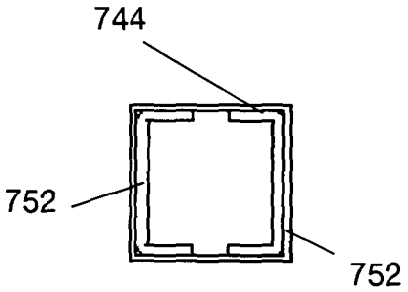
FIG. 34 is a plan view of the extension element of FIG. 32.

In embodiments, an extension element 742 is provided to extend the height of a deck support leg 30, or a support post 47, for example. The extension element 742 has an upper portion 744 of substantially the same width and construction as a portion of the deck support leg 30 or support post 47. One or more apertures 746 may be provided through the one or more walls of the upper portion, for attaching a sleeve arrangement or securing arrangement, or the like, to the extension element 742. FIGS. 32 to 34 show aspects of an extension element 742. In FIG. 32, the extension element 742 is shown in engagement with a portion of a deck support leg 748, to which a securing arrangement 800 is shown to be attached. The extension element 742 comprises an engagement portion 750 for engaging an upper portion of a deck support leg 30, or a support post 47, or the like. The engagement portion 750 comprises a pair of extension connection members 752 which are adapted to fit within the upper portion of the deck support leg 30, so as to lie substantially parallel the side walls of the deck support leg 30. Apertures 756 are defined by portions of extension connection members 752, which are configured to lie adjacent corresponding apertures defined by the deck support leg 30, enabling insertion of pins, bolts, or the like, to secure the engagement portion 750 to the upper portion of the deck support leg 30. In this manner, the upper portion 744 of the extension element 742 provides an extension to the length of the deck support leg 30.

Figure 35:
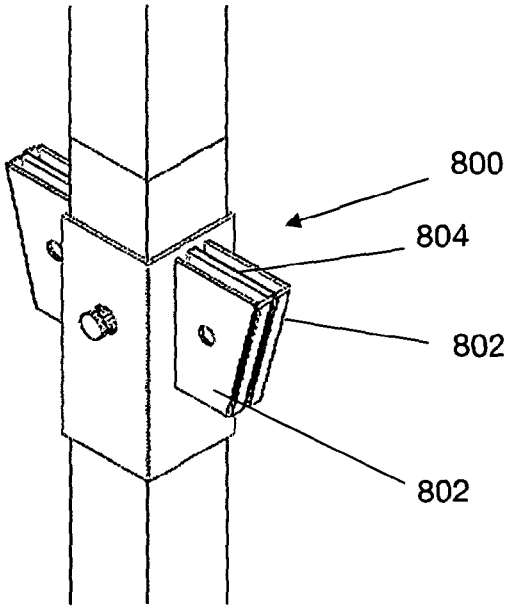
FIG. 35 is a perspective view of a securing arrangement according to embodiments of the invention.
Figure 36:
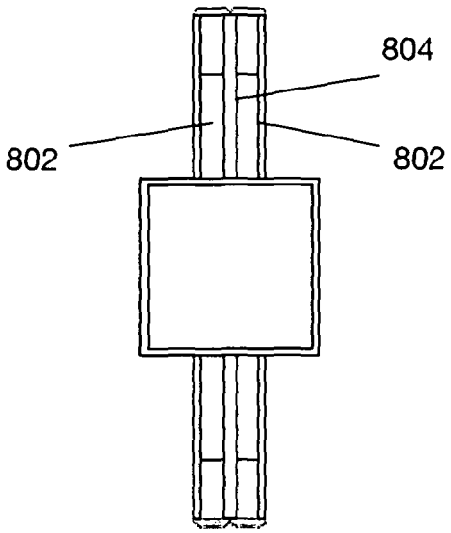
FIG. 36 is a plan view of the securing arrangement of FIG. 35.
Figure 37:
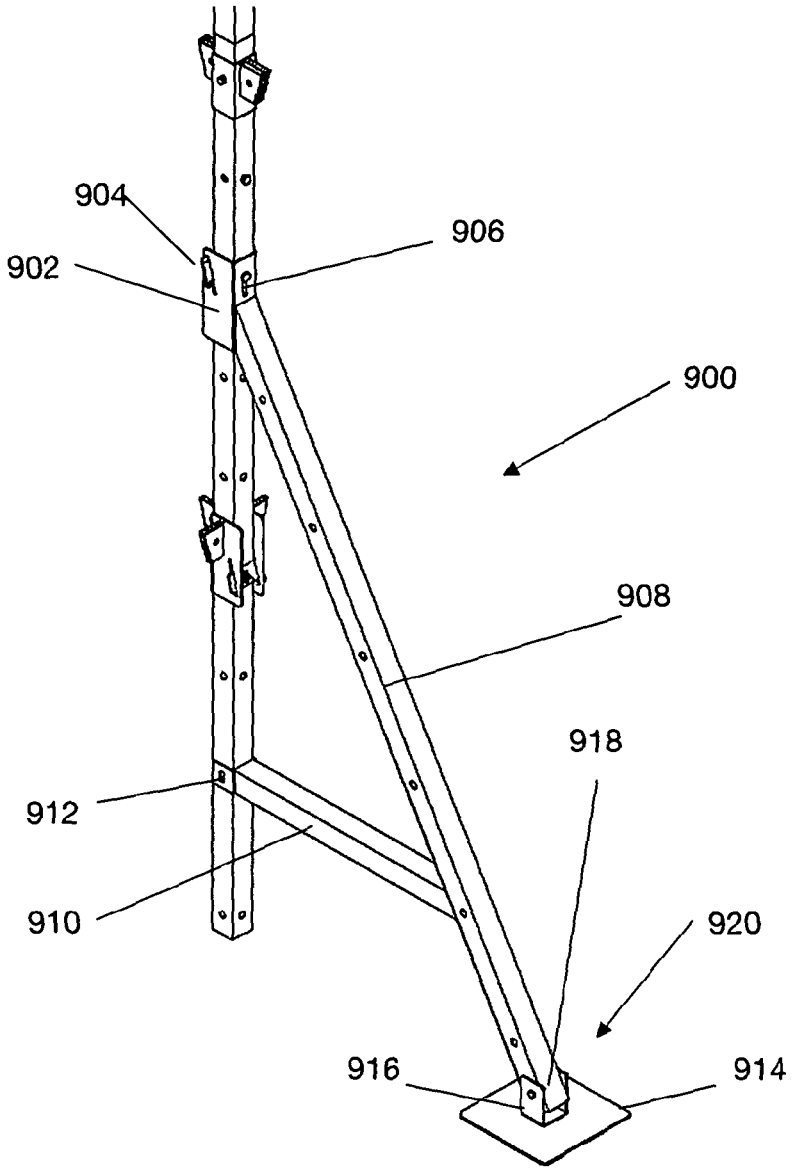
FIG. 37 is a perspective view of a support arrangement of embodiments of the invention shown in connection with a deck support leg.
Figure 38:
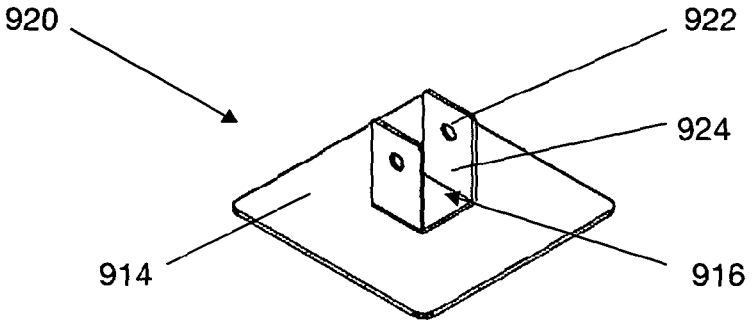
FIG. 38 is a perspective view of a support member foot of the support arrangement of FIG. 37.

With reference to FIG. 35, a securing arrangement 800 is shown, the securing arrangement 800 providing first and second receiving arrangements each having first and second receiving formations 802. Each pair of receiving formations is similar to those of the embodiment shown in FIG. 15, comprising first and second female slot arrangements, disposed generally parallel to one another so as to receive first and second engaging members of adjacent deck elements 314 and separated by a dividing wall 804.

In embodiments, in addition to or instead of the support arrangements previously described, further support arrangements 900 may be provided. The further support arrangements 900 comprise a support member 908 having a first end for connection to a first portion of a deck support leg 30, or the like, by a support member attachment arrangement 906, and a second end 918 supported on a surface by a support member foot 920 (at a position spaced from the deck support leg). The support member foot 920 is typically supported on the ground surrounding the modular platform, and comprises a plate 914 configured to lie against the ground to provide support. A pivot arrangement 916 is disposed on the plate 914, providing a pivoting connection between the lower end 918 of the support member 908 and the plate 914. This configuration enables the plate 914 to be spaced laterally from the deck support leg 30 and the support member 908 to be pivoted relative to the plate 914 about the pivot arrangement 916, so that the support member attachment arrangement 906 can be connected to a portion of the support leg 30.

The support member attachment arrangement 906 comprises a sleeve portion 902 that is connected to the upper end of the support member 908, and configured to surround partially a portion of the deck support leg 30, in a manner similar to the sleeve arrangement 700 of FIGS. 27 to 31. A pair of slots is provided in the sleeve portion 902, such that a latch member 904 and bolt may be used to secure the support member attachment arrangement 906 to the deck support leg 30 in the same manner as that of the sleeve arrangement 700 as previously described. However, it should be understood that any suitable connection mechanism such as bolt or latching mechanism may be used—such as a may be described herein, for example.

The further support arrangement 900 also provides a support arm 910 for connection between the support member 908 (at any one of a plurality of locations) and a second portion of the deck support leg 30 (spaced vertically from the first portion), so as to hold the support member 908 at a position spaced laterally from the deck support leg 30. The support arm 910 includes a support arm connection arrangement 912, which may comprise a sleeve for receiving the deck support leg 30, or a partial sleeve and latch mechanism, or the like, for connection to a portion of the deck support leg 30. The support arm connection arrangement 912 may provide a pair of apertures adapted to align with apertures in the deck support leg 30, to allow insertion of a pin or bolt so as to secure the support arm connection arrangement 912 to the deck support leg 30.

Figure 39:
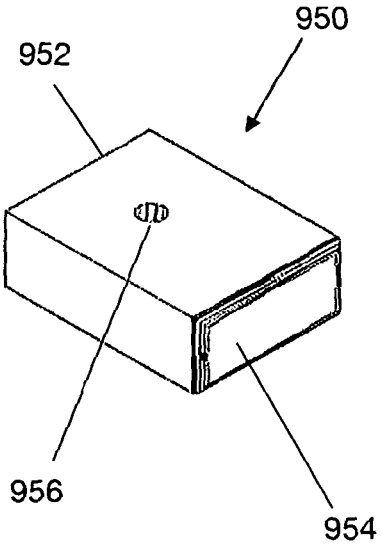
FIG. 39 is a perspective view of a buffer member.
Figure 40:
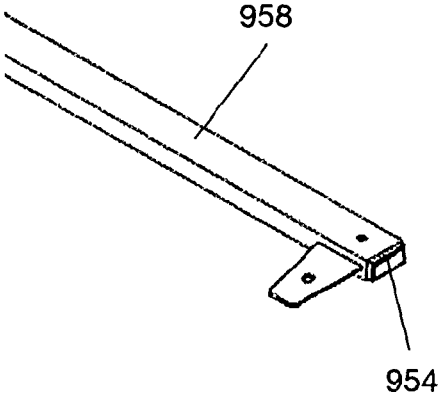
FIG. 40 is a perspective view of a buffer member in engagement with a barrier member.

In embodiments, with reference to FIGS. 39 and 40, a buffer member 950 is provided for engagement with an end of a beam 958, a barrier member, a support beam 16, or the like. In embodiments, the buffer member 950 comprises a body 952 that is adapted to fit substantially within the beam 601 at an end thereof, such that a buffer surface 954 protrudes a short distance from the end of the beam 958. The buffer surface 954 is preferably formed of a material suitable for 'cushioning' or 'damping' the effects of any impact between the beam 601 and a deck support leg 30, or any other part of the modular platform 10, such as a rubber or plastic material, for example. The body 952 of the buffer member 950 defines and aperture therethrough for alignment with a corresponding pair of apertures in the beam 958, so that a pin, bolt, or the like may be inserted therethrough to secure the buffer member 950 relative to the beam 958. The cushioning or damping effect provided by the buffer surface 954 serves to reduce or eliminate the likelihood of damage or excessive vibration transmissions being caused by contact between a beam 958 and other parts of the modular apparatus. Furthermore, the buffer surface 954 may provide a tighter fit between the end of a beam 958 and a deck support leg 30, resulting in a more secure structure with reduced vibration between components and a tighter-fitting modular structure.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A platform comprising:

a deck element having four supporting beams, a load-bearing member secured to at least one of the four support beams, and a plurality of first connection arrangements, wherein one of the four support beams is disposed along each edge of the load bearing member in a square or rectangular arrangement; and a plurality of deck support members each having a second connection arrangement;

wherein the deck element is moveable with respect to the plurality of deck support members to connect the deck element to the plurality of deck support members, and wherein each of the first connection arrangements releasably engages a respective one of the second connection arrangements, each first connection arrangement being an engaging member, and each respective second connection arrangement being a receiving formation, such that movement of the engaging member in a first engaging direction causes the engaging member to engage the receiving formation, to restrict movement of the deck element relative to the respective deck support member in at least one plane, wherein the deck element includes a plurality of corners and each corner consists of a single engagement structure consisting of a single one of the engaging members, and engagement of the first and the second connection arrangements at each corner supports the deck element with respect to the plurality of deck support members, wherein the engaging members include at least one engaging member which extends through a plane which is generally perpendicular to a plane of extension of another of the engaging members, wherein a single deck support member supports four of the deck elements at substantially one level, and wherein each of the engaging members comprises a male part, and each of the receiving formations comprises a female slot arrangement for receiving the male part.

2. The platform according to claim 1, wherein each deck support member comprises a deck support leg, and further comprising a plurality of stabilizing feet, each foot comprising a sleeve adapted to receive a first end of a respective one of the plurality of deck support legs, and a stabilizing portion extending outwardly from the sleeve portion, wherein the sleeve of the foot defines a peripheral aperture, and the first end of the respective deck support leg defines an opening adapted to align with the aperture defined by the upright sleeve for receiving a retaining member so as to secure the deck support leg relative to the stabilizing foot.

3. The platform according to claim 2, further including one or more support members having a body with a first end and a second end, wherein the first end of the support member includes a first securing arrangement configured for securing the first end of the support member relative to a first one of the deck support legs and the second end of the support member includes a second securing arrangement for securing the second end of the support member relative to a second one of the deck support legs, so as to hold a first deck support leg of the deck support legs relative to a second deck support leg of the deck support legs.

4. The platform according to claim 3, wherein the first securing arrangement comprises a connecting sleeve that is adapted to surround a portion of the first end of the first deck support leg, and wherein the connecting sleeve is adapted to surround a portion of the sleeve of the foot, the connecting sleeve defining a peripheral aperture adapted to align with the peripheral aperture defined by the sleeve of the foot and with the opening in the deck support leg so as to receive the retaining member to secure the deck support leg, the stabilizing foot, and the support member relative to each other, and wherein the connecting sleeve defines a pair of peripherally spaced apertures, the sleeve of the foot defining a pair of peripherally spaced apertures adapted to align with the apertures through the connecting sleeve, and the opening within the deck support leg passes therethrough, so as to align with the apertures through the sleeve of the foot and connecting sleeve, for receiving the retaining member therethrough.

5. The platform according to claim 4, wherein the second securing arrangement comprises a first arm and a second arm, each arm being fixed substantially rigidly relative to the body of the support member, and each of the first and second arms being configured to surround at least partially a portion of the respective second deck support leg, and wherein each of the first and second arms comprises a first portion disposed generally outwardly from the body of the support member, and a second portion forming a substantially rigid elbow joint with the first portion such that the second portion is disposed generally perpendicular to the first portion, the second portion of the first arm extending from the first portion of the first arm generally toward the second arm, and the second portion of the second arm extending from the first portion of the second arm generally toward the first arm, such that each arm surrounds a portion of the perimeter of the second deck support leg.

6. The platform according to claim 5, wherein the second portion of each of the first arm and second arm comprises a frictional sleeve, providing a surface for abutting a portion of the second deck support leg so as to resist relative movement between the arm and the deck support.

7. The platform according to claim 2, further comprising at least one barrier arrangement comprising:

a pair of support posts, each support post having at a first end a third connection arrangement for engagement with a fourth connection arrangement disposed at a second end of a respective deck support leg such that the support post is connected to and supported by the respective deck support leg, and a fifth connection arrangement disposed at a position on the length of the support post, and a barrier member having a first end and a second end, each end comprising a sixth connection arrangement for engagement with a respective fifth connection arrangement of a respective one of the support posts, such that the barrier member is connected to and supported by the pair of support posts.

8. The platform according to claim 1, wherein each engaging member comprises a male part, and each receiving formation comprises a female slot arrangement for receiving the male part, including a pair of generally parallel side walls extending from the respective surface comprising the receiving formation and having an outer wall generally perpendicular to the plane of the side walls and extending between the side walls along at least a portion of their respective edges, and wherein each receiving formation is provided with a fastening arrangement configured so as to secure releasably a respective engaging member in engagement with the receiving formation.

9. The platform according to claim 2, wherein at least one receiving formation is comprised by a sleeve arrangement, the sleeve arrangement comprising a sleeve portion forming a C-shaped channel adapted to abut three sides of a deck support leg, at least one wall of the sleeve portion providing the receiving formation comprising a female slot arrangement for receiving one of the male parts.

10. The platform according to claim 9, further including a latch member for engagement with a pair of slots defined at positions opposite one another adjacent either end of the C-shaped channel of the sleeve portion, so as to inhibit disengagement of the sleeve arrangement from a deck support leg abutted on three of its sides within the C-shaped channel, and wherein an aperture is defined by the latch member, such that alignment of that aperture with an aperture defined through the deck support leg and an aperture defined by a wall of the sleeve portion allows insertion of a portion of a bolt or pin through the aligned apertures, for restricting relative vertical movement between the sleeve arrangement and the deck support leg.

11. The platform according to claim 2, further comprising an extension element having an upper portion having substantially the same width as a deck support leg, and an engagement portion adapted to fit within an upper portion of a deck support leg, the engagement portion defining apertures configured to lie adjacent corresponding apertures defined by the deck support leg for receiving pins or bolts to secure the engagement portion relative to the deck support leg, and further comprising a buffer member comprising a body adapted to fit at least partially within an end of a support beam, such that a buffer surface of the buffer member protrudes from the end of the support beam, the buffer surface being formed of a material suitable for cushioning or damping the effects of an impact.

12. The platform according to claim 2, including a support arrangement, comprising a support member having a first end for connection to a first portion of a deck support leg and a second end configured to be supported on a surface at a position spaced from the deck support leg, and a support arm for connection between the support member and a second portion of the deck support leg, the second portion being spaced vertically from the first portion, wherein the second end of the support member provides a support member foot comprising a plate configured to lie against a surface, and a pivot arrangement for providing a pivoting connection between the support member and the plate.

* * * * *